US011499337B2

(12) United States Patent
Ohrstrom

(10) Patent No.: US 11,499,337 B2
(45) Date of Patent: Nov. 15, 2022

(54) FENCE PANEL SYSTEM

(71) Applicant: VISION EXTRUSIONS GROUP LIMITED, Woodbridge (CA)

(72) Inventor: Rolf Ohrstrom, Woodbridge (CA)

( * ) Notice: Subject to any disclaimer, the term of this patent is extended or adjusted under 35 U.S.C. 154(b) by 767 days.

(21) Appl. No.: 16/190,554

(22) Filed: Nov. 14, 2018

(65) Prior Publication Data

US 2019/0186168 A1 Jun. 20, 2019

Related U.S. Application Data

(60) Provisional application No. 62/585,912, filed on Nov. 14, 2017.

(51) Int. Cl.
*E04H 17/16* (2006.01)

(52) U.S. Cl.
CPC ..... *E04H 17/166* (2013.01)

(58) Field of Classification Search
CPC ... E04H 17/16; E04H 17/1602; E04H 17/165; E04H 17/166
See application file for complete search history.

(56) References Cited

U.S. PATENT DOCUMENTS

| | | | |
|---|---|---|---|
| 1,114,486 | A | 10/1914 | Kimball |
| 2,218,953 | A | 10/1940 | Gustafson |
| 2,218,954 | A | 10/1940 | Gustafson |
| 2,608,386 | A | 8/1952 | Hart |
| 2,723,107 | A | 11/1955 | Parker |
| 3,083,951 | A | 4/1963 | Huret |
| 3,136,530 | A | 6/1964 | Case |
| 3,164,354 | A | 1/1965 | Murdock |
| 3,289,381 | A | 12/1966 | Blum et al. |
| 3,343,811 | A | 9/1967 | Kusel et al. |

(Continued)

FOREIGN PATENT DOCUMENTS

| | | | |
|---|---|---|---|
| CA | 3088392 | A1 * | 10/1990 |
| CA | 1318164 | | 5/1993 |

(Continued)

OTHER PUBLICATIONS

Non-Final office action dated Feb. 16, 2021 from related U.S. Appl. No. 16/188,788, 11 pages.

(Continued)

*Primary Examiner* — Jonathan P Masinick
(74) *Attorney, Agent, or Firm* — Ruggiero McAllister & McMahon LLC

(57) ABSTRACT

A modular privacy fence system, in particular, a modular privacy fence system having fence panels with a board-on-board appearance is disclosed. The fence system includes one or more fence panels having at least two fence panel portions that are cooperatively configured such that the fence panel portions are disposed in partial overlapping relationship such that one of the fence panel portions is offset relative to an adjacent one or ones of the fence panel portions. The fence panel portions are formed within a unitary, one-piece construction and may be in the form of plastic extrusions. The fence panels are configured for coupling to adjacent fence panels, the one or more fence panels being disposed between spaced apart upper and lower rails with the fence panels being connected, respectively, to the upper and lower rails.

27 Claims, 21 Drawing Sheets

(56) References Cited

U.S. PATENT DOCUMENTS 3,385,567 A 5/1968 Case et al.
3,388,884 A 6/1968 Eggler et al.
3,398,981 A 8/1968 Vincens
3,403,641 A 10/1968 Baker
3,485,006 A 12/1969 DeRozario
3,490,797 A 1/1970 Platte
3,491,984 A 1/1970 Nyberg
3,498,589 A 3/1970 Murdock
3,506,243 A 4/1970 Seiler
3,555,762 A * 1/1971 Costanzo, Jr. .... E04F 15/02161 52/588.1
3,606,718 A * 9/1971 Curran ..... E04D 3/36 52/542
3,610,427 A 10/1971 Maziarka et al.
3,617,077 A 11/1971 Cavanaugh, Sr.
3,618,993 A 11/1971 Platte
3,752,553 A 8/1973 Bildahl et al.
3,756,567 A 9/1973 Murdock
3,759,007 A * 9/1973 Thiele ..... E04F 13/0889 52/533
3,822,053 A 7/1974 Daily
3,918,686 A 11/1975 Knott et al.
3,931,946 A 1/1976 Soltysik
3,973,756 A 8/1976 Lauzier
4,007,919 A 2/1977 Totten
4,014,520 A 3/1977 Walters
4,035,978 A 7/1977 Bajorek et al.
4,050,828 A 9/1977 Noro
4,148,454 A 4/1979 Carlson et al.
4,189,796 A 2/1980 Gutner
4,266,757 A 5/1981 Kirkwood
4,340,199 A 7/1982 Brock
4,389,133 A 6/1983 Oberst
4,390,164 A 6/1983 Cokelekoglu
4,390,165 A 6/1983 Murlock
4,477,058 A 10/1984 Lowery
4,480,854 A 11/1984 Doty
4,565,465 A 1/1986 Oberst
4,586,697 A 5/1986 Tornya
4,623,128 A 11/1986 Dutch et al.
4,674,593 A 6/1987 McCarty
4,725,044 A 2/1988 Cluff
4,797,020 A 1/1989 Winston
4,805,879 A 2/1989 Spera
4,809,955 A 3/1989 Veilleux
4,883,256 A 11/1989 Hebda
4,919,394 A 4/1990 Otte et al.
4,929,116 A 5/1990 Mahl
4,976,567 A 12/1990 Spier
4,995,591 A 2/1991 Humphrey et al.
5,011,325 A 4/1991 Antonioli
5,078,367 A 1/1992 Simpson et al.
5,247,773 A 9/1993 Weir
5,284,359 A 2/1994 Baba
5,454,548 A 10/1995 Moore
5,533,237 A 7/1996 Higgins
5,544,866 A 8/1996 Dye
5,628,495 A 5/1997 Gandara
5,660,378 A 8/1997 Schall
5,702,090 A * 12/1997 Edgman ..... E04H 17/1447 256/19
5,713,171 A 2/1998 Andres
5,725,201 A * 3/1998 Parth ..... E04H 17/1417 256/24
5,836,714 A 11/1998 Christensen
5,862,642 A 1/1999 Erwin
5,882,001 A 3/1999 Reinbold
5,988,599 A 11/1999 Forbis
6,029,954 A 2/2000 Murdaca
6,042,296 A 3/2000 Wittig et al.
D427,322 S 6/2000 DeSouza
6,135,425 A 10/2000 Platt
6,173,944 B1 1/2001 McCarthy
6,202,987 B1 3/2001 Forbis
6,290,214 B1 9/2001 DeSouza
6,293,523 B1 9/2001 Fendler
6,305,670 B1 10/2001 Ward et al.
6,311,955 B1 * 11/2001 McGarry ..... E04H 17/1417 256/24
6,375,166 B1 4/2002 Schall
6,398,193 B1 6/2002 DeSouza
6,446,398 B2 9/2002 Weir
6,460,829 B1 10/2002 Forbis et al.
6,467,756 B1 10/2002 Elsasser
6,478,287 B2 11/2002 DeSouza
6,508,457 B1 1/2003 Knudson et al.
6,523,807 B2 * 2/2003 Calverley ..... E01F 8/0017 256/25
6,524,518 B1 2/2003 Pelfrey
6,595,497 B1 7/2003 Linford et al.
6,631,887 B1 10/2003 Walmsley
6,637,728 B2 10/2003 Pettit et al.
6,698,726 B2 3/2004 Platt
6,702,259 B2 3/2004 Pratt
6,719,277 B2 4/2004 Dhanesian
6,752,385 B2 6/2004 Zen et al.
6,752,386 B1 6/2004 Bundy
6,752,438 B2 6/2004 DeSouza
6,755,394 B2 6/2004 Forbis et al.
6,823,638 B2 * 11/2004 Stanchfield ..... E04F 15/02 52/586.2
6,874,766 B2 4/2005 Curatolo
6,932,328 B2 8/2005 Shreiner et al.
7,007,363 B2 3/2006 Forbis
7,021,607 B1 4/2006 Alexander
7,032,891 B2 4/2006 Rowley et al.
7,048,259 B2 5/2006 Quaintance et al.
7,152,849 B2 12/2006 Graber
7,165,374 B2 1/2007 Ohanesian
7,168,689 B2 1/2007 Giralt
7,347,412 B1 3/2008 Zhu
7,360,754 B2 4/2008 Robbins
7,434,789 B2 10/2008 Crumrine
7,438,284 B2 10/2008 McGinness et al.
7,445,196 B2 11/2008 Cantley et al.
7,478,797 B2 1/2009 Laws et al.
7,500,654 B2 3/2009 Rosaen
7,530,550 B2 5/2009 Fattori
7,543,802 B2 6/2009 Petta et al.
7,546,900 B2 6/2009 Humphries
7,635,114 B2 12/2009 Laws et al.
7,641,180 B2 1/2010 Adderton
7,654,401 B2 2/2010 Obergoenner
7,641,963 B2 4/2010 Grafenauer
7,744,065 B2 6/2010 Terrels et al.
7,789,376 B2 9/2010 Diamond et al.
7,802,351 B2 9/2010 McGinness et al.
7,857,291 B2 12/2010 Dombroski
8,046,965 B2 11/2011 Rieber
8,210,503 B2 * 7/2012 Garrison ..... E04H 17/16 256/24
D670,405 S 11/2012 McKenzie
8,403,303 B2 3/2013 Payne et al.
8,584,425 B2 * 11/2013 Wagner ..... E04F 13/0837 52/588.1
8,616,331 B2 12/2013 Humphries et al.
8,899,555 B2 12/2014 Sherstad
9,027,909 B1 5/2015 Peyton
9,435,134 B2 9/2016 Walmsley
10,190,331 B2 1/2019 Delafield et al.
10,400,402 B1 9/2019 Sanders et al.
10,422,156 B1 9/2019 Morrow
2002/0000454 A1 1/2002 Pettit et al.
2002/0000544 A1 * 1/2002 Pettit ..... E04H 17/16 256/19
2002/0023406 A1 2/2002 Pettit et al.
2002/0056251 A1 5/2002 Venegas, Jr.
2002/0109132 A1 8/2002 Tsao
2003/0196395 A1 10/2003 Forbis et al.
2004/0009338 A1 1/2004 Jo et al.
2004/0018666 A1 1/2004 Lee et al.
2004/0026679 A1 2/2004 Terrels et al.
2004/0051092 A1 3/2004 Curatolo

(56) References Cited

U.S. PATENT DOCUMENTS

| | | | | |
|---|---|---|---|---|
| 2004/0051093 | A1 | 3/2004 | Manning | |
| 2004/0188666 | A1 | 9/2004 | Pratt | |
| 2005/0075423 | A1 | 4/2005 | Riebel et al. | |
| 2005/0199866 | A1 | 9/2005 | Green | |
| 2005/0242336 | A1 | 11/2005 | Giacchino | |
| 2006/0001015 | A1 | 1/2006 | Forbis et al. | |
| 2006/0113517 | A1 | 6/2006 | Colantonio | |
| 2006/0202186 | A1 | 9/2006 | Rowley et al. | |
| 2006/0273295 | A1 | 12/2006 | Maly et al. | |
| 2006/0273502 | A1* | 12/2006 | Sade | E04H 17/168 269/41 |
| 2007/0062146 | A1* | 3/2007 | Van Dijk | E04B 1/86 52/580 |
| 2007/0158630 | A1 | 7/2007 | Lo | |
| 2007/0170410 | A1 | 7/2007 | Devine | |
| 2007/0181865 | A1* | 8/2007 | Hein | E04H 17/16 256/24 |
| 2007/0181866 | A1 | 8/2007 | Strong | |
| 2008/0023684 | A1 | 1/2008 | Diamond et al. | |
| 2008/0217598 | A1 | 9/2008 | Dombroski | |
| 2008/0265232 | A1 | 10/2008 | Terrels et al. | |
| 2008/0299351 | A1 | 12/2008 | Buchholtz et al. | |
| 2009/0065755 | A1 | 3/2009 | Sherstad | |
| 2009/0065756 | A1 | 3/2009 | McGinness et al. | |
| 2009/0152523 | A1* | 6/2009 | Erwin | E04H 17/16 256/24 |
| 2009/0226246 | A1 | 9/2009 | Piper et al. | |
| 2010/0096608 | A1* | 4/2010 | McCarthy | E04H 17/16 256/19 |
| 2010/0126797 | A1 | 5/2010 | Humphries et al. | |
| 2010/0155683 | A1 | 6/2010 | Payne et al. | |
| 2010/0200825 | A1 | 8/2010 | Hill | |
| 2010/0237308 | A1 | 9/2010 | Lo | |
| 2011/0001104 | A1 | 1/2011 | Rowley et al. | |
| 2011/0024060 | A1 | 2/2011 | Brownbill | |
| 2011/0073824 | A1 | 3/2011 | Lappin | |
| 2011/0155982 | A1 | 6/2011 | Duffy et al. | |
| 2011/0209436 | A1 | 9/2011 | Fabbri | |
| 2011/0233496 | A1 | 9/2011 | Caruso | |
| 2012/0090140 | A1 | 4/2012 | Montemayor et al. | |
| 2017/0058557 | A1 | 3/2017 | Wu | |
| 2019/0284833 | A1 | 9/2019 | Yeh et al. | |

FOREIGN PATENT DOCUMENTS

| | | | | |
|---|---|---|---|---|
| CA | 2157325 | A1 | 3/1997 | |
| CA | 2279215 | A1 * | 2/2001 | B32B 21/04 |
| CA | 2298963 | A1 | 8/2001 | |
| CA | 2157155 | C | 11/2001 | |
| CA | 2349963 | A1 | 12/2001 | |
| CA | 2362250 | A1 | 5/2002 | |
| CA | 2340600 | A1 | 9/2002 | |
| CA | 2363976 | A1 | 5/2003 | |
| CA | 2624235 | A1 | 9/2009 | |
| CA | 2653263 | A1 | 9/2009 | |
| CA | 2683274 | A1 | 4/2010 | |
| DE | 1684649 | A1 | 12/1969 | |
| DE | 7707911 | U1 | 7/1977 | |
| EP | 0392923 | A1 * | 10/1990 | E01F 8/0023 |
| EP | 0754600 | A1 | 1/1997 | |
| EP | 2520743 | A1 * | 11/2012 | E04H 17/20 |
| FR | 2814529 | A1 | 3/2002 | |
| GB | 2323611 | A * | 9/1998 | E04H 17/16 |
| GB | 2425317 | A * | 10/2006 | E04H 17/1447 |
| JP | H09195476 | A | 7/1997 | |
| WO | 2007119039 | A1 | 10/2007 | |
| WO | 2008078116 | A1 | 7/2008 | |

OTHER PUBLICATIONS

Canadian Intellectual Property Office, Examiner's Requisition and Examination Search Report, Canadian Application No. 2,683,274 dated Dec. 2, 2015, 5 pages.

Canadian Intellectual Property Office, Examiner's Requisition and Examination Search Report, Canadian Application No. 2,669,440 dated Jul. 3, 2015, 5 pages.

Canadian Intellectual Property Office, Examiner's Requisition and Examination Search Report, Canadian Application No. 2,683,274 dated Jun. 27, 2016, 5 pages.

Canadian Intellectual Property Office, Examiner's Requisition and Examination Search Report, Canadian Application No. 2,669,440 dated Jun. 27, 2016, 3 pages.

* cited by examiner

Section A - A

FENCE PANEL SYSTEM

CROSS-REFERENCE TO RELATED APPLICATIONS

This application claims priority under 35 U.S.C. § 119(e) from U.S. Provisional Patent Application No. 62/585,912 filed on Nov. 14, 2017. The entire contents of the priority application is incorporated herein by reference.

BACKGROUND OF THE DISCLOSURE

1. Field of the Disclosure

The present disclosure relates to modular privacy fence systems, in particular, to modular privacy fence systems having fence panels with a board-on-board appearance, and the structure and assembly of the elements of such a fence system.

2. Description of the Related Art

Modular privacy fence systems are known and typically require assembly of a number of different components. For fence systems having a board-on-board appearance, typically, individual slats are layered in overlapping relationship to achieve the desired appearance. Assembly of these types of fence systems, therefore, requires a large number of components and can be labour intensive in order to achieve the desired appearance and privacy effect. A fence system that can achieve the board-on-board appearance and that offers increased privacy with no gaps between individual slats and that are more convenient to install is, therefore, desirable.

SUMMARY OF THE DISCLOSURE

According to one example embodiment of the present disclosure, there is provided a fence system comprising:
one or more fence panels, wherein each one of the one or more fence panels, independently, includes at least two fence panel portions;
wherein:
the at least two fence panel portions define at least one pair of offset adjacent fence panel portions;
for each one of the at least one pair of offset adjacent fence panel portions, independently, a first one of the pair of offset adjacent fence panel portions is offset relative to the second one of the pair of offset adjacent fence panel portions; and
the fence panel portions are formed within a unitary, one-piece construction.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DETAILED DESCRIPTION OF THE DISCLOSURE

Figure 1:
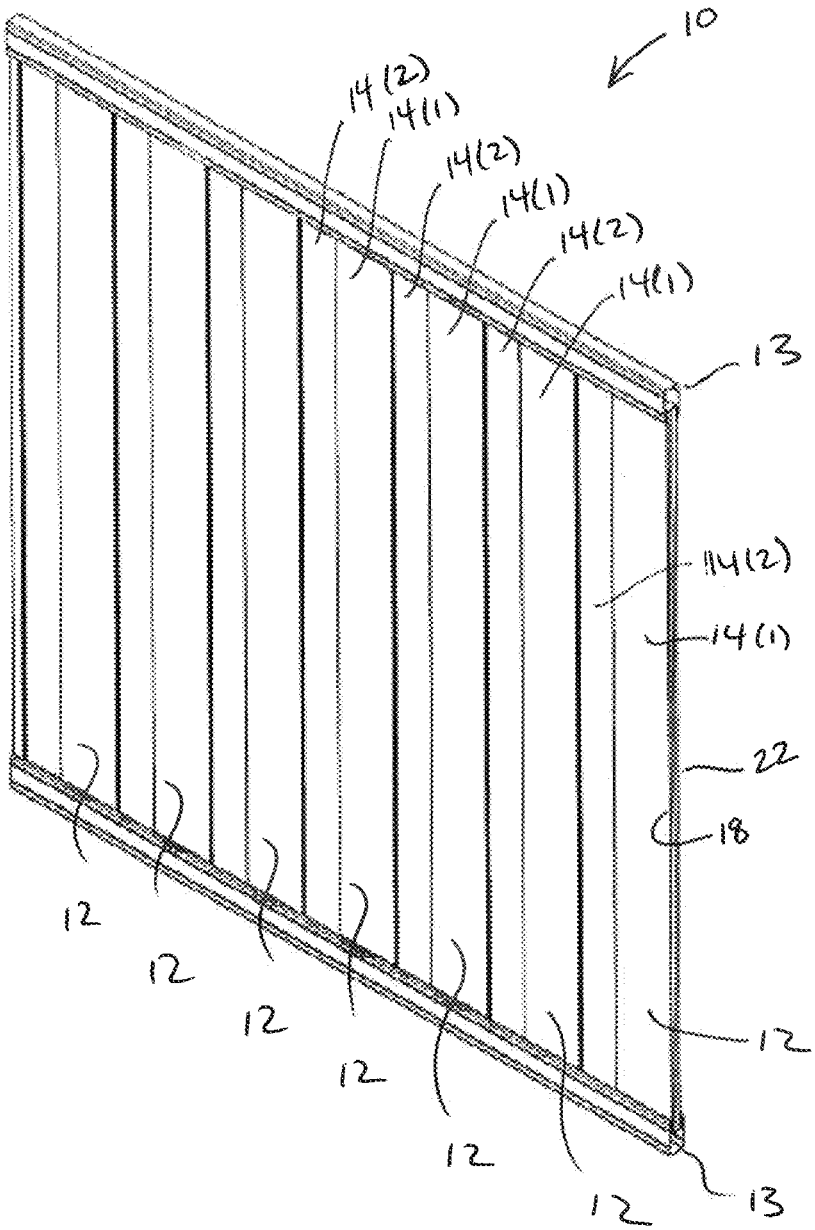
FIG. 1 is an isometric view of a portion of a fence system according to an example embodiment of the present disclosure.
Figure 2:
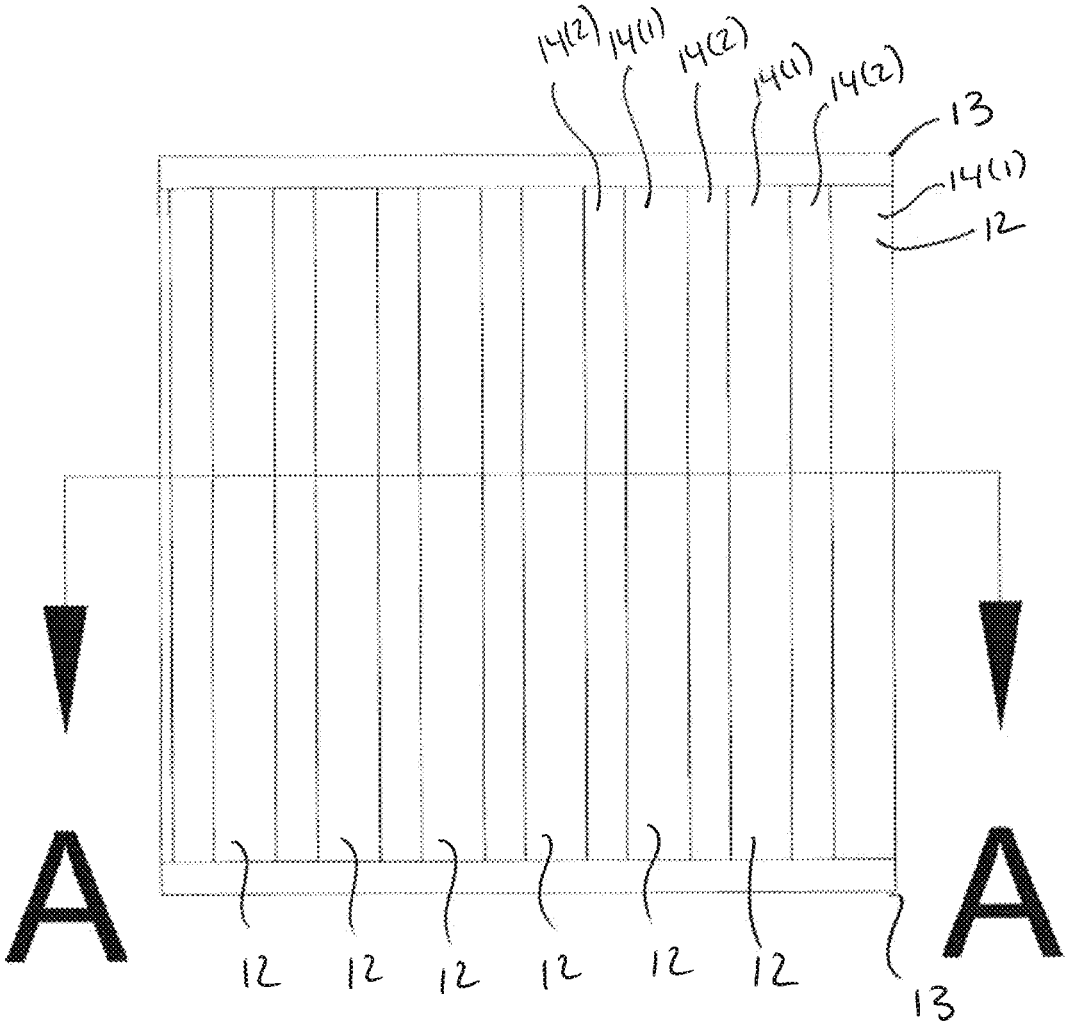
FIG. 2 is a front or rear elevation view of the portion of the fence system of FIG. 1.
Figure 3:
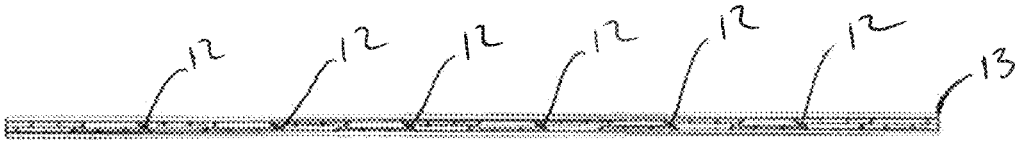
FIG. 3 is a cross-sectional view of the fence system of FIG. 1 taken along section line A-A in FIG. 2.
Figure 4:
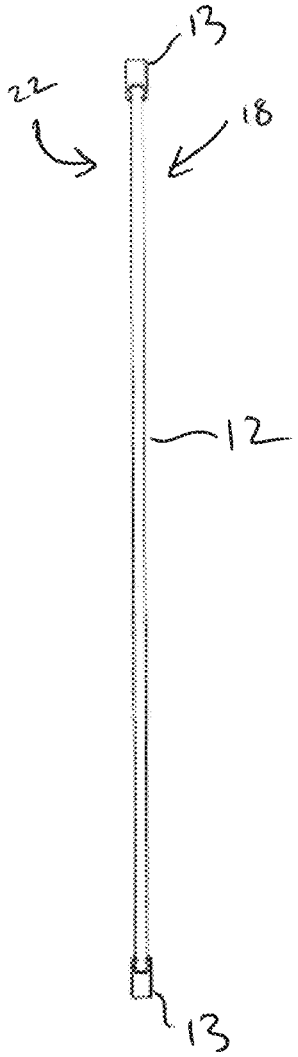
FIG. 4 is an end view of the fence system of FIG. 1.

Referring now to FIGS. 1-5 there is shown a portion of a privacy fence system 10 having a board-on-board appearance according to an example embodiment of the present disclosure.

The fence system 10 includes one or more fence panels 12. In some embodiments, for example, the one or more fence panels 12 are disposed between spaced apart upper and lower longitudinally extending rails 13.

In some example embodiments, the one or more fence panels 12 and the upper and lower rails 13 are made of a plastic material and, in some embodiments, the one or more fence panels 12 and the upper and lower longitudinally extending rails 13 are plastic extrusions.

Each one of the one or more fence panels 12, independently, includes at least two fence panel portions 14. The at least two fence panel portions 14 are formed within a unitary, one-piece construction.

The at least two fence panel portions 14 define at least one pair of offset adjacent fence panel portions 14(1), 14(2). For each one of the at least one pair of offset adjacent fence panel portions 14(1), 14(2), independently, a first one of the pair of offset adjacent fence panel portions 14(1), 14(2) is offset relative to the second one of the pair of offset adjacent fence panel portions 14(1), 14(2). Accordingly, the offset adjacent fence panel portions 14(1), 14(2) of the pair of offset adjacent fence panel portions 14(1), 14(2) are disposed in a partial overlapping relationship such that one of the fence panel portions 14(1) is offset relative to the adjacent one 14(2) in the pair of offset adjacent fence panel portions 14(1), 14(2).

For each one of the one or more fence panels 12, each one of the fence panels 12, independently, includes a first side 18 and a second side 22 opposite to the first side 18.

Figure 6A:
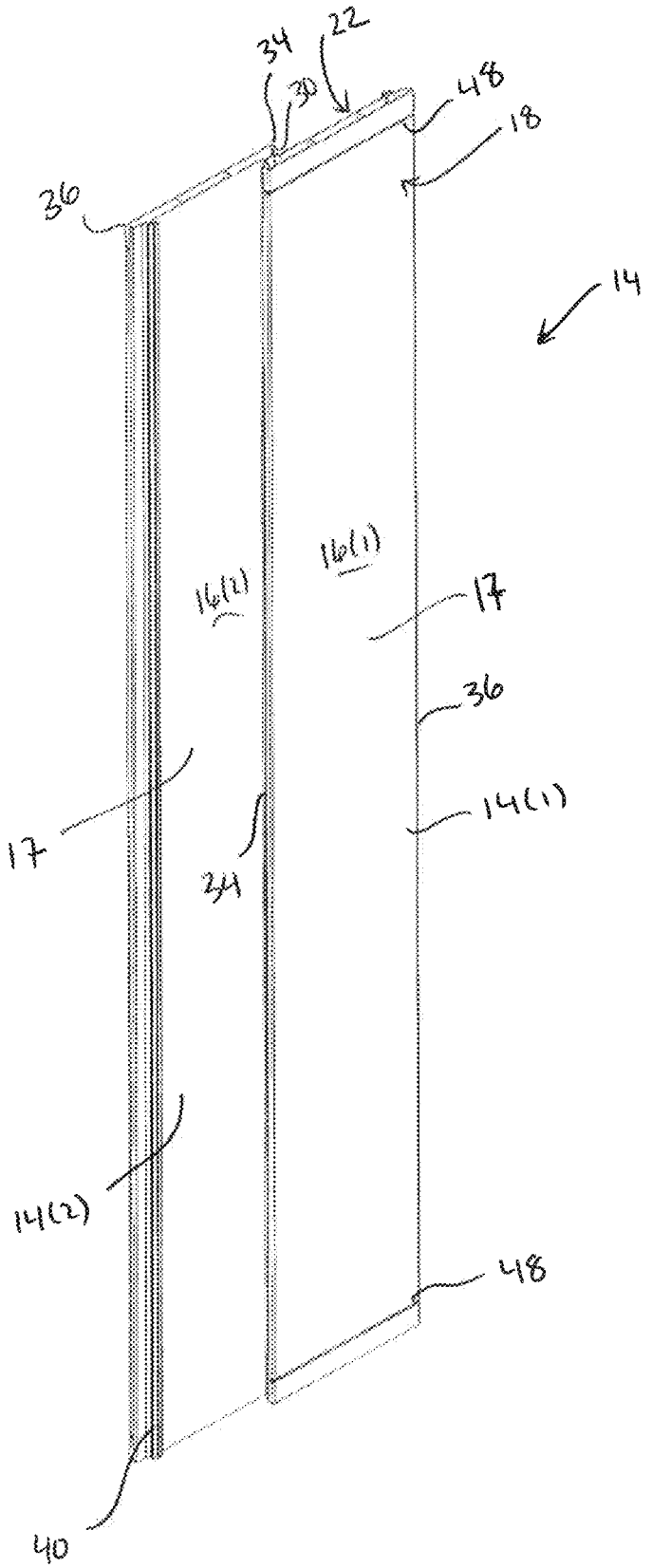
FIG. 6A is a front, perspective view of one of the fence panels of the fence system shown in FIG. 1.
Figure 6B:
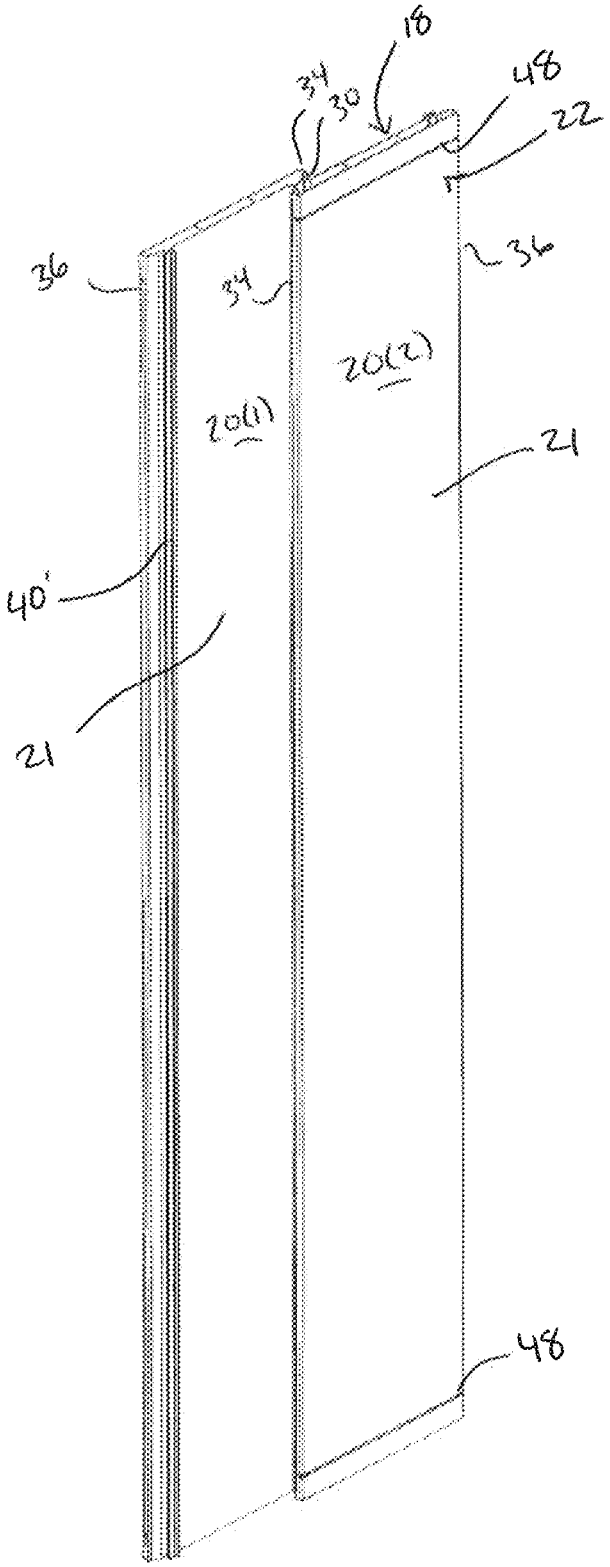
FIG. 6B is a rear, perspective view of the fence panel of FIG. 6A.

Referring now to FIGS. 6A and 6B, each one of the fence panel portions 14(1), 14(2) of the pair of offset adjacent fence panel portions 14(1), 14(2), independently, includes a respective first side surface portion 16(1), 16(2) of the first side 18 of the fence panel 12. For each one of the at least one pair of offset adjacent fence panel portions 14(1), 14(2), independently, the first side surface portion 16(1) of a first one 14(1) of the pair of offset adjacent fence panel portions 14(1), 14(2) is offset relative to the first side surface portion 16(2) of the second one 14(2) of the pair of offset adjacent fence panel portions 14(1), 14(2).

The first side surface portions 16(1), 16(2) each define a first planar surface 17. The first planar surface 17 of a first one 14(1) of the pair of offset adjacent fence panel portions 14(1), 14(2) is offset relative to the first planar surface 17 of the second one 14(2) of the pair of offset adjacent panel portions 14(1), 14(2).

The first planar surface 17 of a first one 14(1) of the fence panel portions 14(1) in the pair of offset adjacent fence panel portions 14(1), 14(2) is parallel, or substantially parallel, to the respective first planar surface 17 of the second one of the fence panel portions 14(2).

In some embodiments, for example, the first planar surface 17 has a surface area of at least about 36 square inches. In some example embodiments, the first planar surface 17 has a surface area between about 36 square inches and 480 square inches.

In some embodiments, for example, the first planar surface 17 of a first one 14(1) of the fence panel portions 14 in the pair of offset adjacent fence panel portions 14(1), 14(2) is offset relative to the first planar surface 17 of the second one 14(2) of the fence panel portions 14 in the pair of offset adjacent fence panel portions 14(1), 14(2) by a minimum distance of at least about ⅛ of an inch.

In some embodiments, for example, the first planar surface 17 of a first one 14(1) of the fence panel portions 14 in the pair of offset adjacent fence panel portions 14(1), 14(2) is offset relative to the first planar surface 17 of the second one 14(2) of the fence panel portions 14 in the pair of offset adjacent fence panel portions 14(1), 14(2) by a minimum distance of at least about ⅜ of an inch.

In some embodiments, for example, the first planar surface 17 of a first one 14(1) of the fence panel portions 14 in the pair of offset adjacent fence panel portions 14(1), 14(2) is offset relative to the first planar surface 17 of the second one 14(2) of the fence panel portions 14 in the pair of offset adjacent fence panel portions 14(1), 14(2) by a minimum distance of between about ⅛ of an inch and about 2 inches.

In some embodiments, for example, the first planar surface 17 of a first one 14(1) of the fence panel portions 14 in the pair of offset adjacent fence panel portions 14(1), 14(2) is offset relative to the first planar surface 17 of the second one 14(2) of the fence panel portions 14 in the pair of offset adjacent fence panel portions 14(1), 14(2) by a minimum distance of between about ⅜ of an inch and about ½ of an inch.

A first side fence panel longitudinal axis 19 extends between the first side surface portion 16(1) of a first one 14(1) of the pair of offset adjacent fence panel portions 14(1), 14(2) and the first side surface portion 16(2) of the second one 14(2) of the pair of offset adjacent fence panel portions 14(1), 14(2), such that, the first side surface portion 16(1) of the first one 14(1) of the pair of offset adjacent fence panel portions 14(1), 14(2) is disposed on an opposite side of the first side fence panel longitudinal axis 19 relative to the first side surface portion 16(2) of the second one 14(2) of the pair of offset adjacent fence panel portions 14(1), 14(2).

In some embodiments, for example, the first side surface portion 16(1) has a minimum length of between about 3 inches to about 5 inches, and in some embodiments, the first side surface portion has a minimum length of at least about 3 inches.

In some embodiments, for example, the first side surface portion 16(1), 16(2) has a minimum height of at least about 12 inches, and in some embodiments, the first side surface portion 16(1), 16(2) has a minimum height of between about 12 inches and about 96 inches.

The second side 22 of the one or more fence panels 12 will now be described in further detail with reference to FIG. 6B. The second side 22 of the fence panel 12 is disposed on an opposite side of the fence panel 12 relative to the first side 18.

Similar to the structure of the first side 18 of the one or more fence panels 12 described above, the fence panels 12 define a second side 22 opposite to the first side 18 wherein each one of the of the fence panel portions 14 of the pair of offset adjacent fence panel portions 14(1), 14(2), independently, includes a respective second side surface portion 20(1), 20(2) of the second side 22 of the fence panel 12. The second side surface portion 20(1) of a first one 14(1) of the fence panel portions 14, of the pair of offset adjacent fence panel portions 14(1), 14(2), is offset relative to the second side surface portion 20(2) of the second one 14(2) of the fence panel portions 14 of the pair of offset adjacent fence panel portions 14(1), 14(2).

The second side surface portion 20(1), 20(2) of each of the pair of offset adjacent fence panel portions 14(1), 14(2) defines a second planar surface 21. The second planar surface 21 of a first one 14(1) of the pair of offset adjacent fence panel portions 14(1), 14(2) is offset relative to the second planar surface 21 of the second one 14(2) of the pair of offset adjacent fence panel portions 14(1), 14(2). The second planar surface 21 of a first one 14(1) of the fence panel portions 14 in the pair of offset adjacent fence panel portions 14(1), 14(2), is parallel, or substantially parallel, to the respective second planar surface 21 of the second one 14(2) of the fence panel portions 14 in the pair of offset adjacent fence panel portions 14(1), 14(2).

In some embodiments, for example, the second planar surface 21 has a surface area of at least about 36 square inches. In some embodiments, for example, the second planar surface has a surface area of between about 36 square inches to about 480 square inches.

In some embodiments, for example, the second planar surface 21 of a first one 14(1) of the fence panel portions 14 of the pair of offset adjacent fence panel portions 14(1), 14(2) is offset relative to the second planar surface 21 of the second one 14(2) of the fence panel portions 14 of the pair of offset adjacent fence panel portions 14(1), 14(2) by a minimum distance of at least about ⅛ of an inch.

In other embodiments, for example, the second planar surface 21 of a first one 14(1) of the fence panel portions 14 of the pair of offset adjacent fence panel portions 14(1), 14(2) is offset relative to the second planar surface 21 of the second one 14(2) of the fence panel portions 14 of the pair of offset adjacent fence panel portions 14(1), 14(2) by a minimum distance of at least about ⅜ of an inch.

In other embodiments, for example, the second planar surface 21 of a first one 14(1) of the fence panel portions 14 of the pair of offset adjacent fence panel portions 14(1), 14(2) is offset relative to the second planar surface 21 of the second one 14(2) of the fence panel portions 14 of the pair of offset adjacent fence panel portions 14(1), 14(2) by a minimum distance of between about ⅛ of an inch and about two (2) inches.

In other embodiments, for example, the second planar surface 21 of a first one 14(1) of the fence panel portions 14 of the pair of offset adjacent fence panel portions 14(1), 14(2) is offset relative to the second planar surface 21 of the second one 14(2) of the fence panel portions 14 of the pair of offset adjacent fence panel portions 14(1), 14(2) by a minimum distance of between about ⅜ of an inch and about ½ of an inch.

A second side fence panel longitudinal axis 23 extends between the second side surface portion 20(1) of a first one 14(1) of the pair of offset adjacent fence panel portions 14(1), 14(2) and the second side surface portion 20(2) of the second one 14(2) of the pair of offset adjacent fence panel portions 14(1), 14(2), such that, the second side surface portion 20(1) of the first one 14(1) of the pair of offset adjacent fence panel portions 14(1), 14(2) is disposed on an opposite side of the second side fence panel longitudinal axis 23 relative to the second side surface portion 20(2) of the second one 14(2) of the pair of offset adjacent fence panel portions 14(1), 14(2).

In some embodiments, for example, the second side surface portion 20(1), 20(2) has a minimum length of at least about 3 inches.

In some embodiments, for example, the second side surface portion 20(1), 20(2) has a minimum length of at least about three (3) inches and about five (5) inches.

In some embodiments, for example, the second side surface portion 20(1), 20(2) has a minimum height of at least about 12 inches.

In some embodiments, for example, the second side surface portion 20(1), 20(2) has a minimum height of at least of between about 12 inches and about 96 inches.

A web portion 30 extends from a first one 14(1) of the pair of offset adjacent fence panel portions 14(1), 14(2) to the second one 14(2) of the pair of offset adjacent fence panel portions 14(1), 14(2). The web portion 30, therefore, spaces apart the first one 14(1) of the pair of offset adjacent fence panel portions 14(1), 14(2) from the second one 14(2) of the pair of offset adjacent fence panel portions 14(1), 14(2).

In some embodiments, for example, the web portion 30 extends from a first one 14(1) of the pair of offset adjacent fence panel portions 14(1), 14(2) to the second one 14(2) of the pair of offset adjacent fence panel portions 14(1), 14(2) by a minimum distance of at least about ⅛ of an inch, as measured along a longitudinal axis of the web portion 30.

In some embodiments, for example, the web portion 30 extends from a first one 14(1) of the pair of offset adjacent fence panel portions 14(1), 14(2) to the second one 14(2) of the pair of offset adjacent fence panel portions 14(1), 14(2) by a minimum distance of at least about ⅜ of an inch, as measured along a longitudinal axis of the web portion 30.

In some embodiments, for example, the web portion 30 extends from a first one 14(1) of the pair of offset adjacent fence panel portions 14(1), 14(2) to the second one 14(2) of the pair of offset adjacent fence panel portions 14(1), 14(2) by a minimum distance of between about ⅛ of an inch and about two (2) inches, as measured along a longitudinal axis of the web portion 30.

In some embodiments, for example, the web portion 30 extends from a first one 14(1) of the pair of offset adjacent fence panel portions 14(1), 14(2) to the second one 14(2) of the pair of offset adjacent fence panel portions 14(1), 14(2) by a minimum distance of between about ⅜ of an inch and about ½ of an inch, as measured along a longitudinal axis of the web portion.

Referring to FIGS. 6A, 6B and 7-12, the fence panel portions 14 of the pair of offset adjacent fence panel portions 14(1), 14(2) are disposed in a partial overlapping relationship. Each one of the fence panel portions 14(1), 14(2) of the pair of offset adjacent fence panel portions 14(1), 14(2), independently, has a pair of spaced apart vertically-oriented edge portions 34, 36. The offset relationship of a first one 14(1) of the pair of offset adjacent fence panel portions 14(1), 14(2) relative to the second one 14(2) of the pair of offset adjacent fence panel portions 14(1), 14(2) is such that one of the vertically-oriented edge portions 34 of a first one 14(1) of the pair of offset adjacent fence panel portions 14(1), 14(2) is spaced apart from one of the vertically-oriented edge portions 34 of the second one 14(2) of the pair of offset adjacent fence panel portions 14(1), 14(2).

In some embodiments, for example, the offset relationship of a first one 14(1) of the pair of offset adjacent fence panel portions 14(1), 14(2) relative to the second one 14(2) of the pair of offset adjacent fence panel portions 14(1), 14(2) is such that a one of the vertically-oriented edge portions 34, 36 of a first one 14(1) of the pair of offset adjacent fence panel portions 14(1), 14(2) overlaps one of the vertically-oriented edge portions 34, 36 of the second one 14(2) of the pair of offset adjacent fence panel portions 14(1), 14(2).

In some embodiments, for example, the web portion 30 is disposed between the corresponding, overlapping vertically-oriented edge portions 34 of the pair of offset adjacent fence panel portions 14(1), 14(2) of the fence panel 12. The web portion 30, therefore, in some embodiments, is inwardly disposed from the overlapping vertically-oriented edge portions 34 of the pair of offset adjacent fence panel portions 14(1), 14(2) of the fence panel 12.

Figure 7:
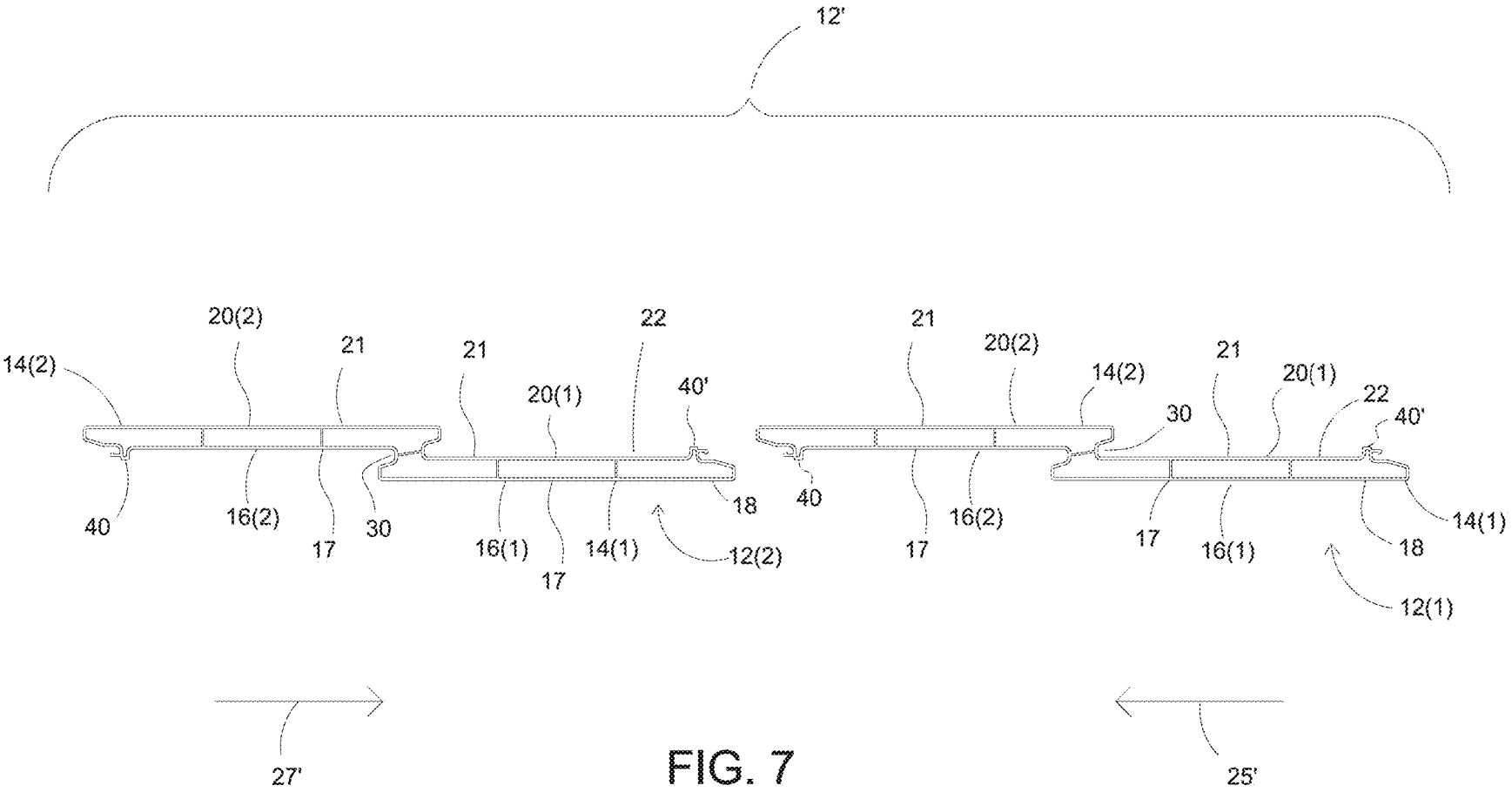
FIG. 7 is a top view of two adjacent, interior fence panels of the fence system of FIG. 1 prior to assembly.
Figure 8:
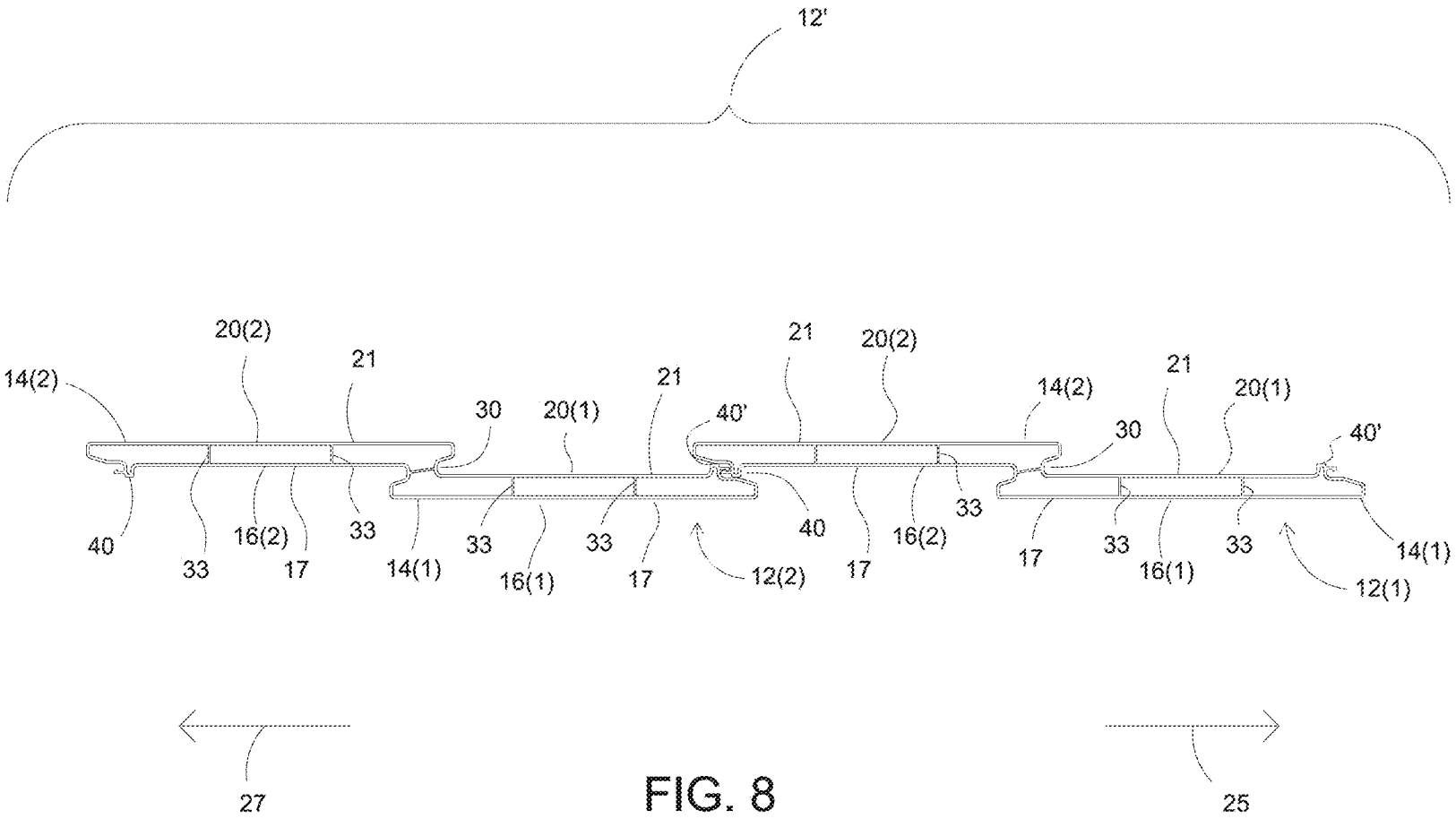
FIG. 8 is a top view of the two adjacent, interior fence panels of FIG. 7 in their assembled state.
Figure 9:
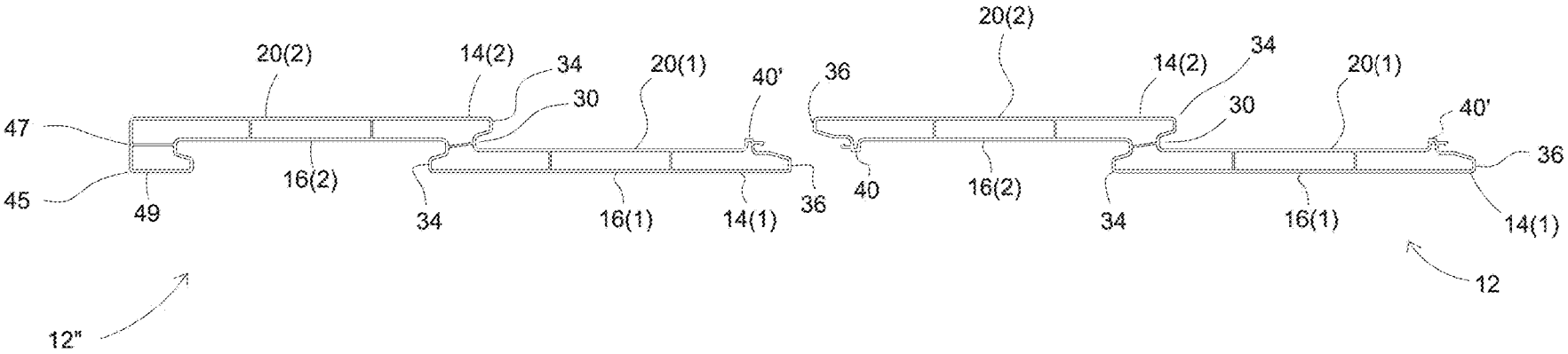
FIG. 9 is a top view of an end fence panel and an adjacent interior fence panel of the fence system of FIG. 1 prior to assembly.
Figure 10:
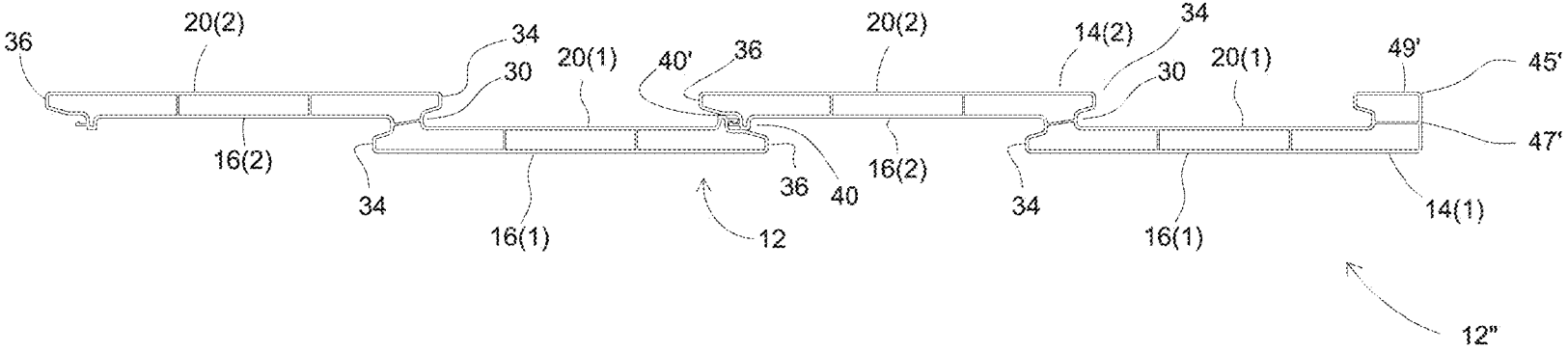
FIG. 10 is a top view of the end fence panel and the adjacent interior fence panel of FIG. 9 in their assembled state.
Figure 11:
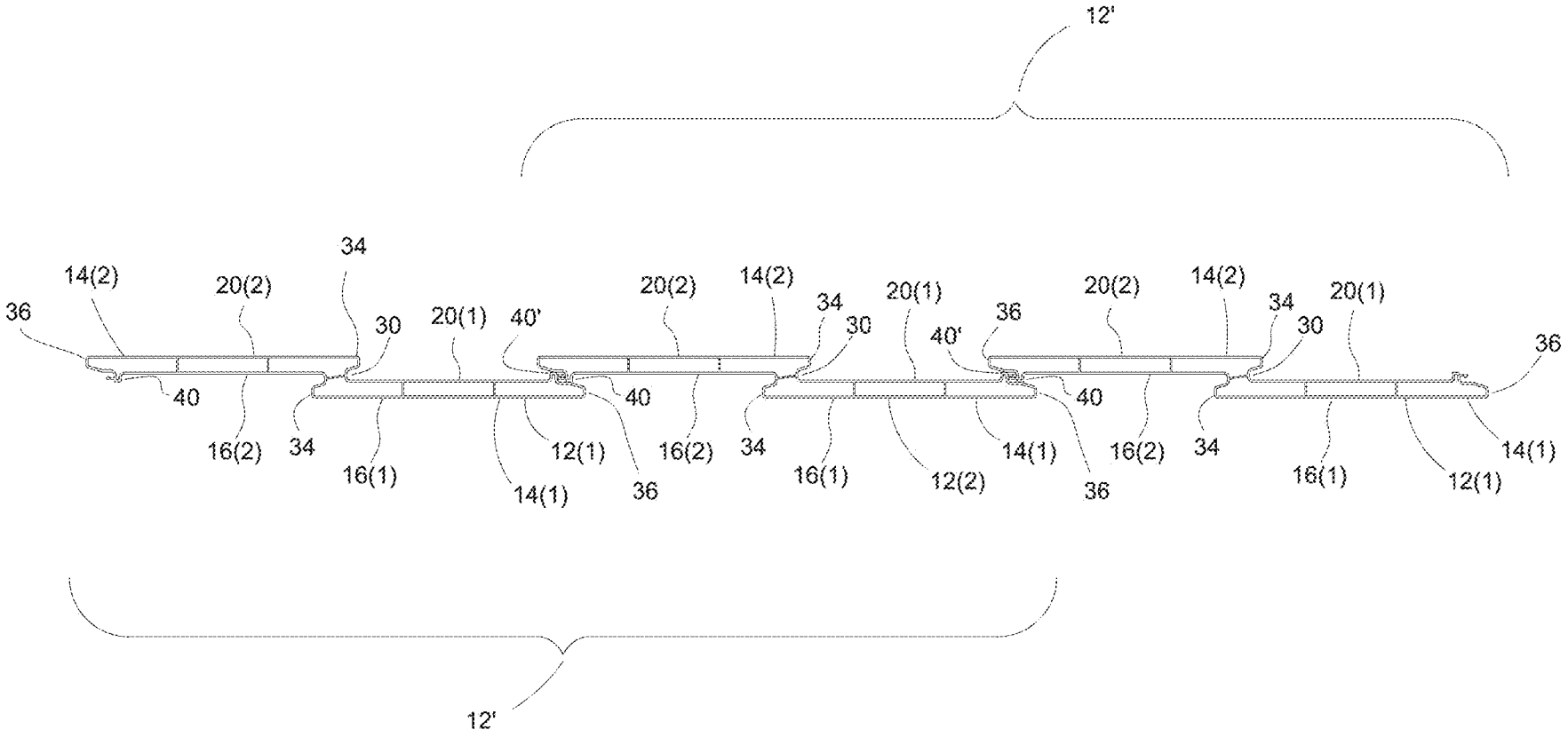
FIG. 11 is a top view of a series of three interior fence panels in their assembled state.

Referring now to FIGS. 7 and 8, the one or more fence panels 12 of the fence system 10 are connected such that at least one pair of connected fence panels 12' is provided. For each pair of connected fence panels 12', independently, a first one 12(1) of the connected fence panels 12 includes a connector 40 that is coupled to a counterpart connector 40' of the second one 12(2) of the connectible fence panels 12 for effecting the connection of the pair of adjacent fence panels 12. The connection of the pair of adjacent fence panels 12 is with effect that the connected pair of fence panels 12' defines adjacent fence panels 12(1), 12(2).

The coupling of the connector 40 to the counterpart connector 40' is with effect that disconnection of the connected pair of adjacent fence panels 12 is resisted in response to the combination of: (i) a first tensile force applied to a first one 12(1) of the connected fence panels 12, in a direction parallel to, or substantially parallel to, the respective longitudinal axis of the first one 12(1) of the connected fence panels 12, and (ii) a second tensile force applied to the second one 12(2) of the connected fence panels 12, in a direction parallel to, or substantially parallel to, the respective longitudinal axis of the second one 12(2) of the connected fence panels 12, and in opposition to the first tensile force, as shown schematically in FIG. 8 by directional arrows 25, 27.

Furthermore, in some embodiments, for example, the connector 40 and the counterpart connector 40' are cooperatively configured such that the coupling is with effect that disconnection of the connected pair of adjacent fence panels 12' is effectible in response to the combination of: (i) a first compressive force applied to a first one 12(1) of the connected fence panels 12', in a direction parallel to, or substantially parallel to, the respective longitudinal axis of the first one 12(1) of the connected fence panels 12', and (ii) a second compressive force applied to the second one 12(2) of the connected fence panels 12, in a direction parallel to, or substantially parallel to, the respective longitudinal axis of the second one 12(2) of the connected fence panels 12, and in opposition to the first compressive force, as shown schematically in FIG. 7 by directional arrows 25', 27'.

In some embodiments, for example, the coupling of the connector 40 to the counterpart connector 40' is effected by interlocking of the connector 40 and the counterpart connector 40'.

In some embodiments, for example, the connector 40 and the counterpart connector 40' are co-operatively configured such that the coupling is with effect that the fence panels 12 of the connected fence panels 12 are slidable relative to each other in a direction orthogonal, or substantially orthogonal relative to the respective longitudinal axis of either one of, or both of, the connected fence panels for effecting disconnection of the connected fence panels 12. The slidability of the fence panels 12 of the connected fence panels 12, relative to each other, is in a vertical direction.

Figure 5:
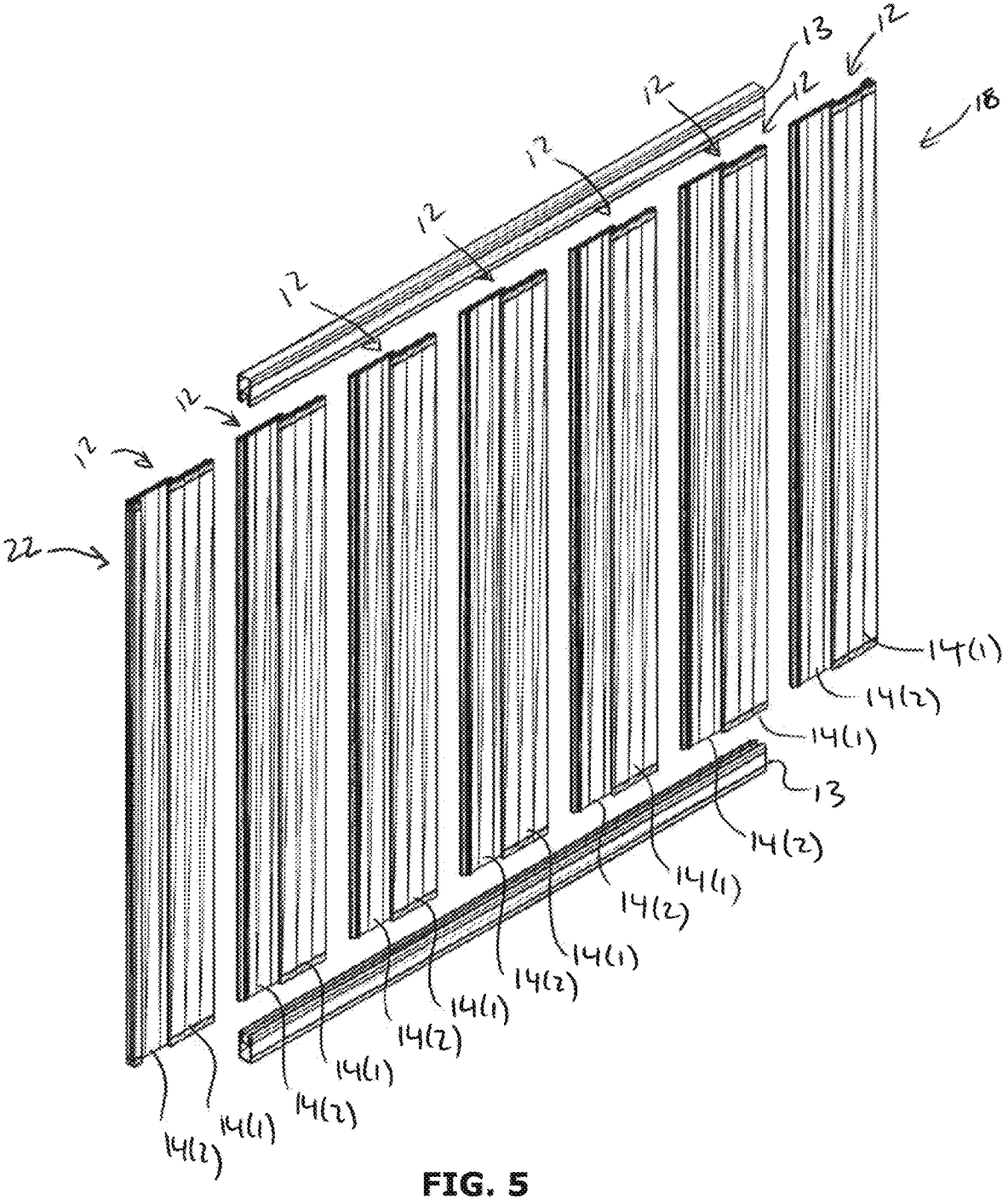
FIG. 5 is an exploded, perspective view of the portion of the fence system of FIG. 1.

Referring to FIG. 5, the one or more fence panels 12 is a plurality of fence panels 12 such that an assembled plurality of fence panels portions 14(1), 14(2) is defined. The assembled plurality of fence panels 12 are disposed in series such that a plurality of pairs of offset adjacent fence panel portions 14(1), 14(2) is defined in the series.

In some embodiments, for example, the assembled plurality of fence panels 12 are opaque, or substantially, opaque.

The assembled plurality of fence panel portions 14 are cooperatively configured such that, for each one of the pairs of offset adjacent fence panel portions 14(1), 14(2) in the series, a respective first side fence panel longitudinal axis 19 extends between the first side surface portion 16(1) of a first one 14(1) of the pair of offset adjacent fence panel portions 14(1), 14(2) in the series and the first side surface portion 16(2) of the second one 14(2) of the pair of offset adjacent fence panel portions 14(1), 14(2) in the series, such that the first side surface portion 16(1) of the first one 14(1) of the pair of offset adjacent fence panel portions 14(1), 14(2) in the series is disposed on an opposite side of the first side fence panel longitudinal axis 19 relative to the first side surface portion 16(2) of the second one 14(2) of the pair of offset adjacent fence panel portions 14(1), 14(2) in the series.

The assembled plurality of fence panel portions 14(1), 14(2), therefore, are co-operatively disposed such that an alternating series of first side surface portions 16(1), 16(2) is provided, wherein extended first side surface portions 16(1) alternate with recessed first side surface portions 16(2).

The second side 22 of the assembled plurality of fence panels 12 is similarly structured in that the assembled plurality of fence panels 12 are cooperatively disposed such a respective second side fence panel longitudinal axis 23 extends between the second side surface portion 20(1) of a first one 14(1) of the adjacent ones of the assembled plurality of fence panel portions 14(1), 14(2) and the second side surface portion 20(2) of the second one 14(2) of the adjacent ones of the assembled plurality of fence panel portions 14(1), 14(2), such that the second side surface portion 20(1) of the first one 14(1) of the adjacent ones of the assembled plurality of fence panel portions 14(1), 14(2) is disposed on an opposite side of the second side fence panel longitudinal axis 23 relative to the second side surface portion 20(2) of the second one 14(2) of the adjacent ones of the assembled plurality of fence panel portions 14(1), 14(2).

Accordingly, the assembled plurality of fence panel portions 14(1), 14(2) are co-operatively disposed such that an alternating series of first side surface portions 16(1), 16(2) is provided, wherein extended first side surface portions 16(1) alternate with recessed first side surface portions 16(2), and an alternating series of second side surface portions 20(1), 20(2) is provided, wherein extended second side surface portions 20(2) alternate with recessed second side surface portions 20(1).

Figure 14:
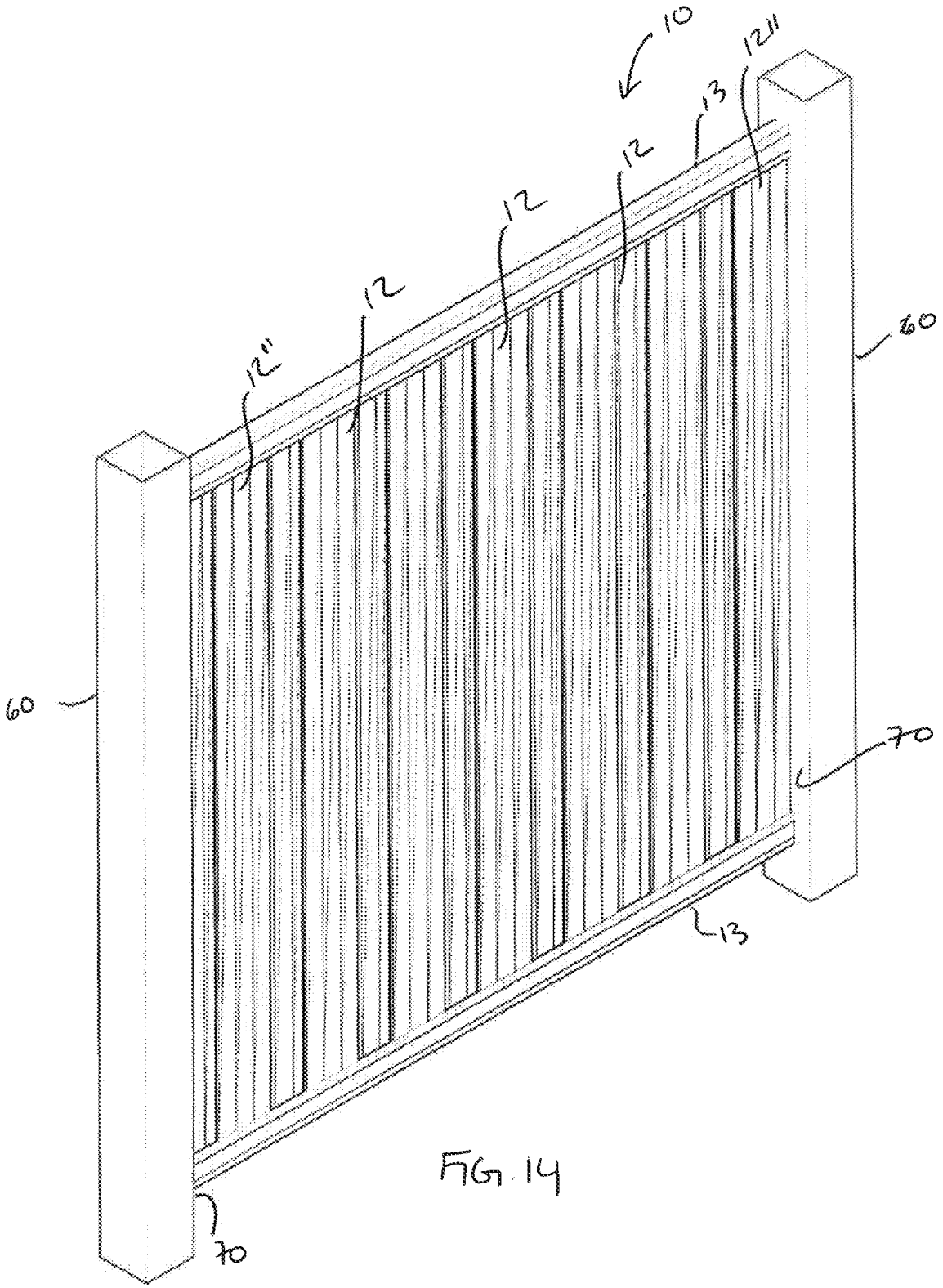
FIG. 14 is a perspective view of the fence system of FIG. 1 disposed between two fence posts.
Figure 15:
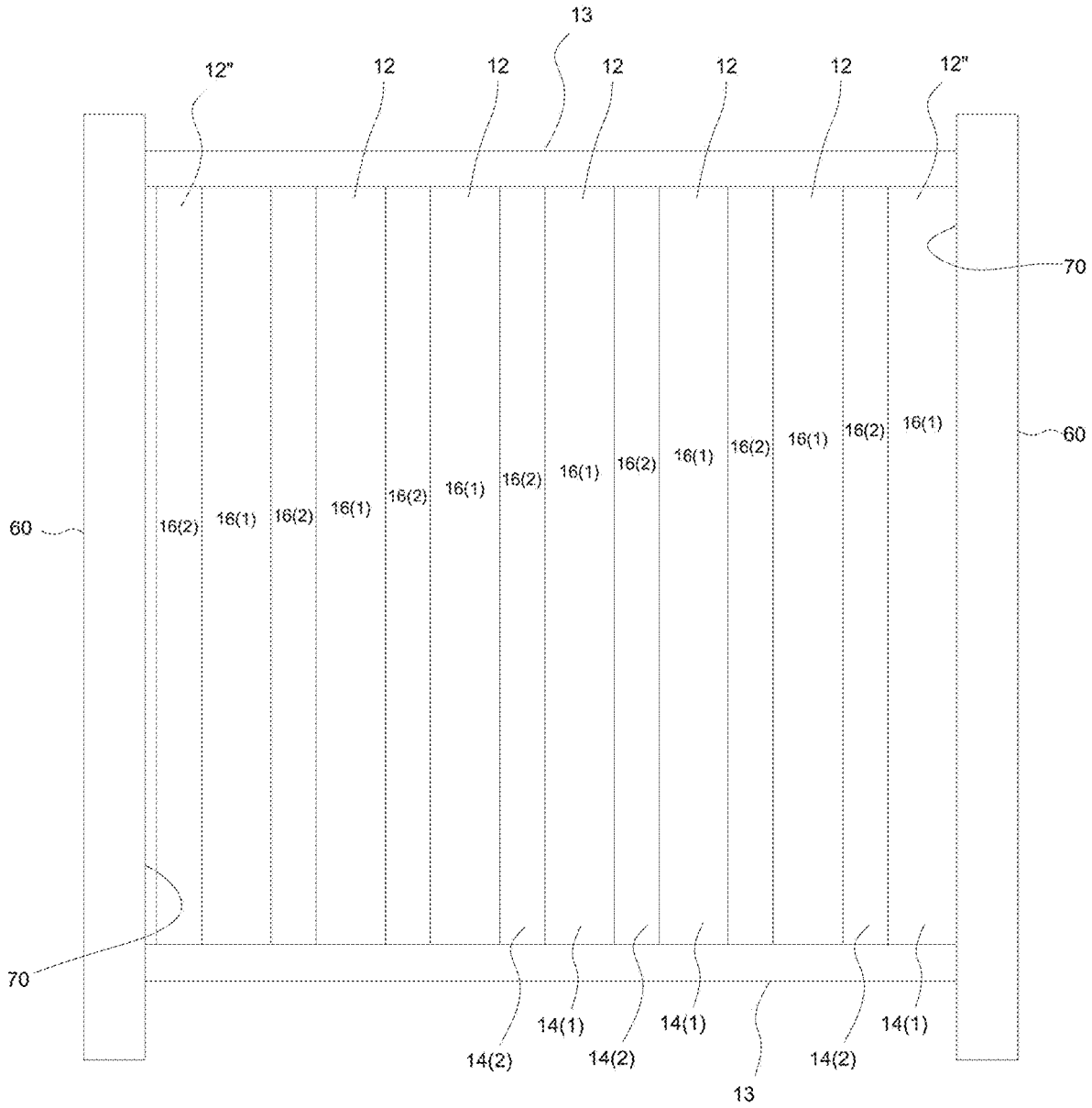
FIG. 15 is a front or rear elevation view of the fence system of FIG. 14.
Figure 16:
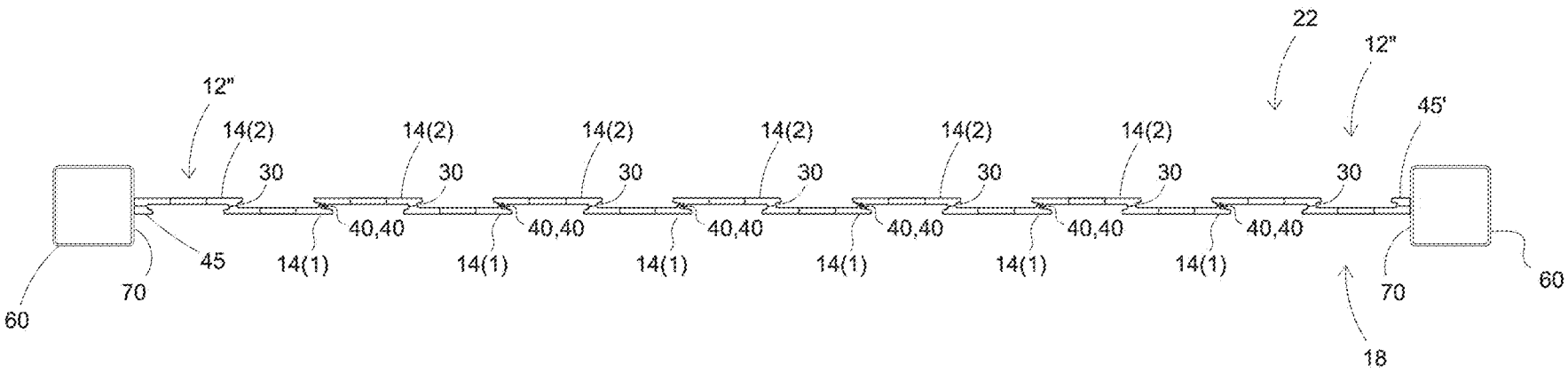
FIG. 16 is a cross-sectional view of the fence system of FIG. 15 taken along section line B-B of FIG. 15.

Referring now to FIGS. 14-16, the fence system 10 further comprises spaced-apart first and second fence posts 60. The assembled plurality of fence panels 12 is disposed between the first and second posts 60. The assembled plurality of fence panels 12 includes: a first end panel 12" disposed at one end of the series and adjacent to one of the first and second posts 60, and a second end panel 12" disposed at the other end of the series and adjacent to the other one of the first and second posts 60.

Figure 12:
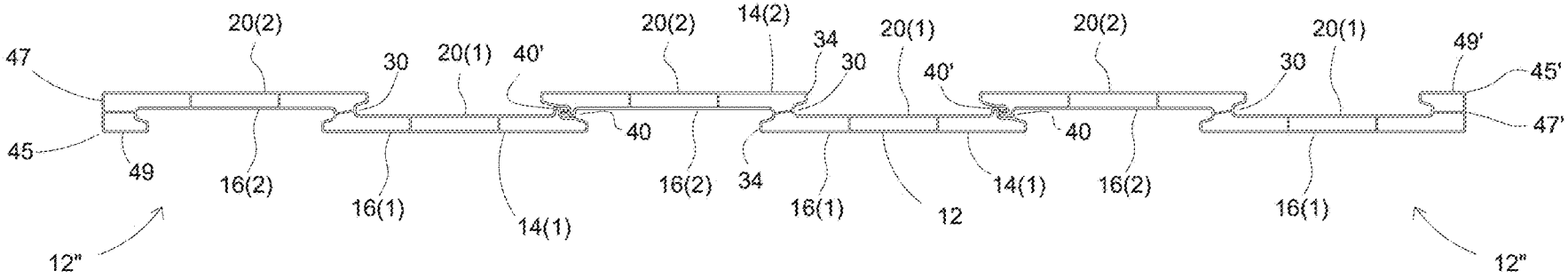
FIG. 12 is a top view of a two end fence panels with an interior fence panel disposed therebetween in their assembled state.

Referring now to FIG. 12, one of the first and second end panels 12" is a first side symmetrical appearance-creating end panel. The first side symmetrical appearance-creating end panel 12" includes a first side projection 45 extending laterally outwardly relative to an adjacent recessed first side surface portion 16(2) disposed between the first side projection 45 and the other one of the first and second fence panel portions 14(1).

The adjacent disposition of the first symmetrical appearance-creating end panel 12", relative to the one of the first and second posts 60, is with effect that the first side projection 45 is disposed adjacent to the one of the first and second posts 60. The distal end of the first side projection 45 defines a first side projection-defined surface 47 that is aligned, or substantially aligned, with a post-adjacent first side surface portion 70 of the other one of the first and second end panels 12", wherein the post-adjacent first side surface portion 70 is disposed adjacent to the other one of the first and second posts 60.

The alignment, or substantial alignment, of the first side projection-defined surface 47 with a post-adjacent first side surface portion 70 of the other one of the first and second end panels 12", is along a vertical plane that is parallel, or substantially parallel, to the vertical plane that extends through the central longitudinal axis of the upper and/or lower longitudinally-extending rails 13, and/or such that the first side projection 45 and the post-adjacent first side surface portion 70 appear extended outwardly by the same, or about the same, extent.

In some embodiments, for example, the other one of the first and second end panels 12" is a second side symmetrical appearance-creating end panel 12". The second side symmetrical appearance-creating end panel includes a second side projection 45' extending laterally outwardly relative to an adjacent recessed second side surface portion 20(1) disposed between the second side projection 45' and the one of the first and second end panels 12". The adjacent disposition of the second side symmetrical appearance-creating end panel 12", relative to the other one of the first and second posts 60, is with effect that the second side projection 45' is disposed adjacent to the other one of the first and second posts 60. The distal end of the second side projection 45' defines a second side projection-defined surface 47' that is aligned, or substantially aligned, with a post-adjacent second side surface portion of the one of the first and second end panels 12", wherein the post-adjacent second side surface portion 47' is disposed adjacent to the one of the first and second posts 60.

In some embodiments, for example, the alignment, or substantial alignment, of the second side projection-defined surface 45' with a post-adjacent second side surface portion 47' of the one of the first and second end panels 12", is along a vertical plane that is parallel, or substantially parallel, to the vertical plane that extends through the central longitudinal axis of the upper and/or lower longitudinally-extending rails, and/or such that the second side projection 45' and the post-adjacent second side surface portion 47' appear extended outwardly by the same, or about the same, extent.

Figure 13A:
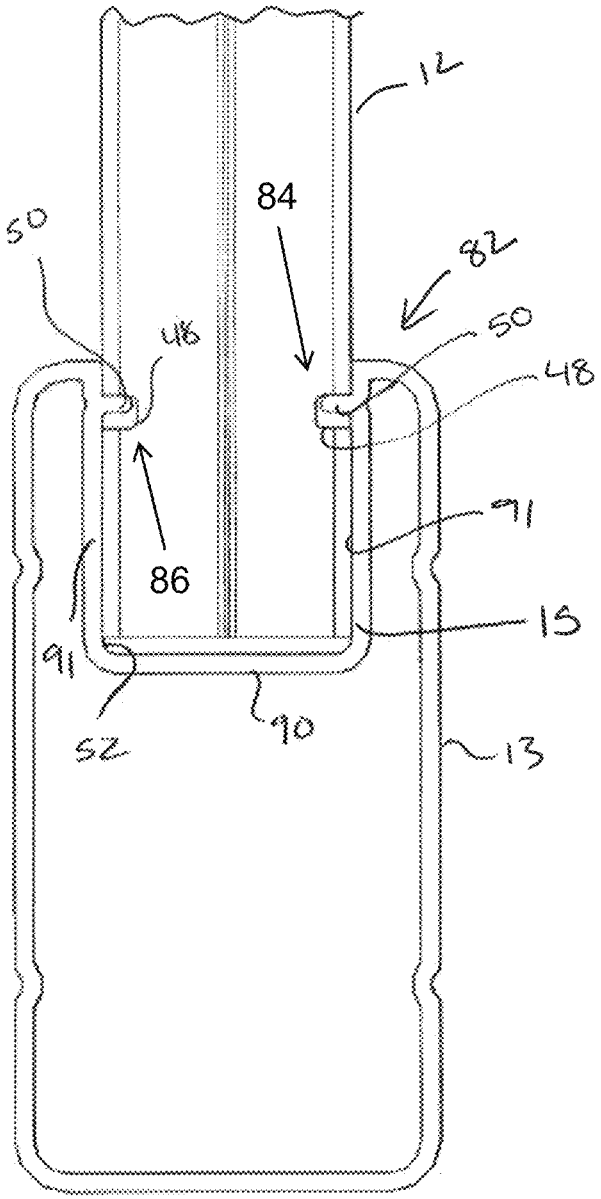
FIG. 13A is a detail view of the encircled area of FIG. 4 showing the lower connection system between the lower rail and the fence panels.
Figure 13B:
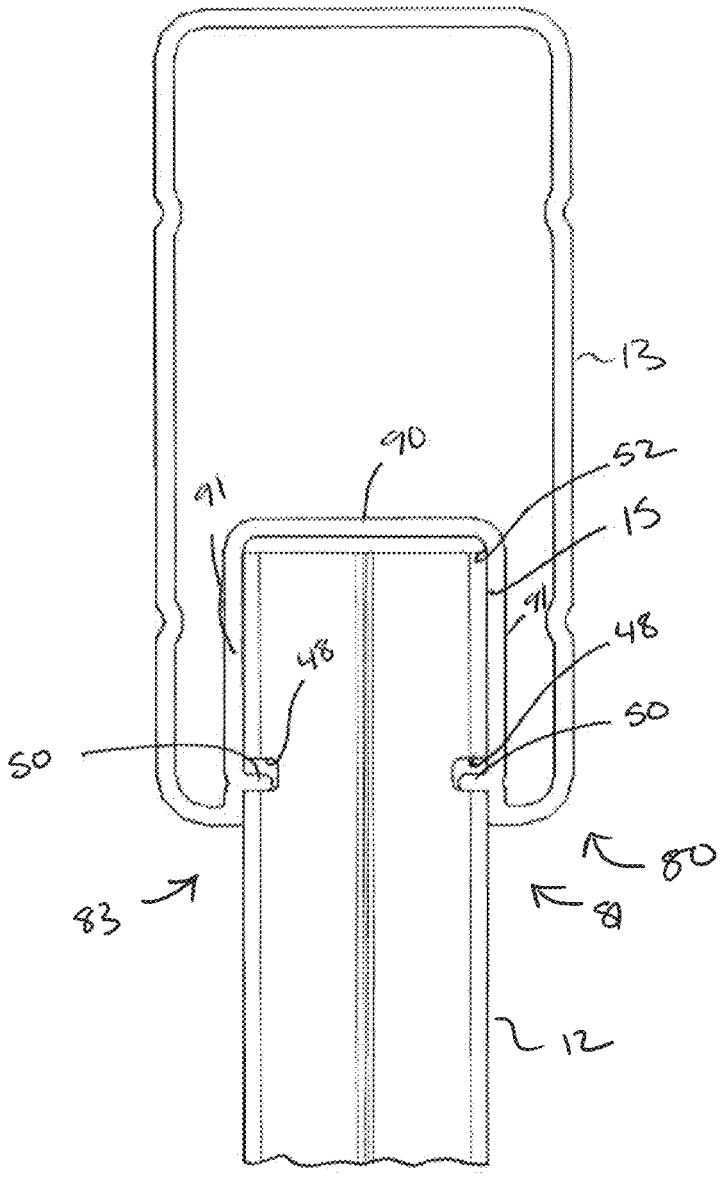
FIG. 13B is a detail view of the upper connection system between the upper rail and the fence panels.

The assembly of the one or more fence panels 12 and the upper and lower longitudinally-extending rails 13 will now be described in further detail having regard to FIG. 5, and FIGS. 13A and 13B.

As set out above, the fence system 10 comprises spaced apart upper and lower longitudinally-extending rails 13, wherein each one of the one or more fence panels 12, independently, extends between the upper and lower longitudinally-extending rails 13. The one or more fence panels 12 are disposed within the upper and lower longitudinally-extending rails 13 by In some embodiments, for example, each one of the one or more fence panels 12, independently, is connected to the upper rail 13 and is also connected to the lower rail 13. The connection to the upper rail 13 is via an upper connection system 80, and the connection to the lower rail is via a lower connection system 82.

In some embodiments, for example, the upper connection system 80 includes a first side connection system 81 and a second side connection system 83 wherein the first side connection system 81 includes a first upper connecting projection 50 extending from the upper rail 13, and a first side slot 48 defined within a first side 18 of the fence panel 12, wherein the first upper connecting projection 50 extends into the first side slot 48 for preventing, or substantially preventing, vertical movement of the fence panel relative to the upper rail 13. The second side connection system 83 includes a second upper connecting projection 50 extending from the upper rail 13, and a second side slot 48 defined within a second side 22 of the fence panel, wherein the second upper connecting projection 50 extends into the second side slot 48 for preventing, or substantially preventing, vertical movement of the fence panel relative to the upper rail 13.

The lower connection system 82 includes a first side connection system 84 and a second side connection system 86 wherein the first side connection system 84 includes a first lower connecting projection 50 extending from the lower rail 13, and a first side slot 48 defined within a first side of the fence panel 12, wherein the first lower connecting projection 50 extends into the first side slot 48 for preventing, or substantially preventing, vertical movement of the fence panel relative to the lower rail. The second side connection system 86 includes a second lower connecting projection 50 extending from the lower rail 13, and a second side slot 48 defined within a second side 22 of the fence pane 12, wherein the second lower connecting projection 50 extends into the second side slot 48 for preventing, or substantially preventing, vertical movement of the fence panel 12 relative to the lower rail 13.

Each one of the upper first side slot 48, the upper second side slot 48, the lower first side slot 48, and the lower second side slot 48, independently extends through a side surface portion 16(1), 20(2) that is extended relative to an adjacent recessed side surface portion 16(2), 20(1).

In some embodiments, for example, the fence panels 12 are hollow, or substantially hollow, structures defined by the spaced apart first side surface portions 16(1), 16(2) and the second side surface portions 20(1), 20(2). In some embodiments, for example, supports 33 are disposed between the spaced apart first side surface portions 16(1), 16(2) and the second side surface portions 20(1), 20(2) of the fence panels 12.

In some embodiments, for example, the upper first side slot 48, the upper second side slot 48, the lower first side slot 48, and the lower second side slot 48, are in the form of saw cuts.

In order to effect the connection between the one or more fence panels 12 and the upper and lower longitudinally extending rails 13, the fence panels 12 are slid into engagement with the upper and lower rails 13 via an open end of the rails 13 such that each one of the first upper connecting projection 50, the second upper connecting projection 50, the first lower connecting projection 50, and the second lower connecting projection 50, independently, becomes disposed within and engages the corresponding slot or saw cut 48.

In some embodiments, for example, the upper and lower rails 13 include a fence panel-receiving channel 15, the fence panel-receiving channel 15 having a base wall 90 and a pair of upstanding side walls 91. In some embodiments, for example, the fence panel-receiving channel 15 defines a fence panel-receiving channel entrance 52 disposed orthogonally, or substantially orthogonally, relative to a longitudinal axis of the upper or lower rail 13, wherein the one or more fence panels 12 are disposed within the fence panel-receiving channel 15 via the fence panel-receiving channel entrance 52. The fence panel-receiving channel entrance 52, therefore, being defined by the open end of the rail 13.

In some embodiments, for example, the projections 50 extend into the fence panel-receiving channel 15 from respective sidewalls 91, the upper first side slot 48, the upper second side slot 48, the lower first side slot 48, and the lower second side slot 48 engaging the corresponding projection 50 while the fence panels 12 are disposed within the fence panel-receiving channel 15 via the fence panel-receiving channel entrance 52 and slid along the longitudinal axis of the fence panel-receiving channel 15.

In some embodiments, for example, the connection between the one or more fence panels 12 and the upper and lower longitudinally extending rails 13 is such that while the one or more fence panels 12 are disposed within the fence panel-receiving channel 15, the assembled one or more fence panels 12 are slidable relative to the upper and lower rails 13 along a longitudinal axis of the rails 13, and resistance to removal of the assembled one or more fence panels 12 from the fence panel-receiving channel 15 in a direction orthogonal, or substantially orthogonal, relative the longitudinal axis of the rails 13 is effected by interaction between the projections 50 and the first and second slots 48.

Figure 17:
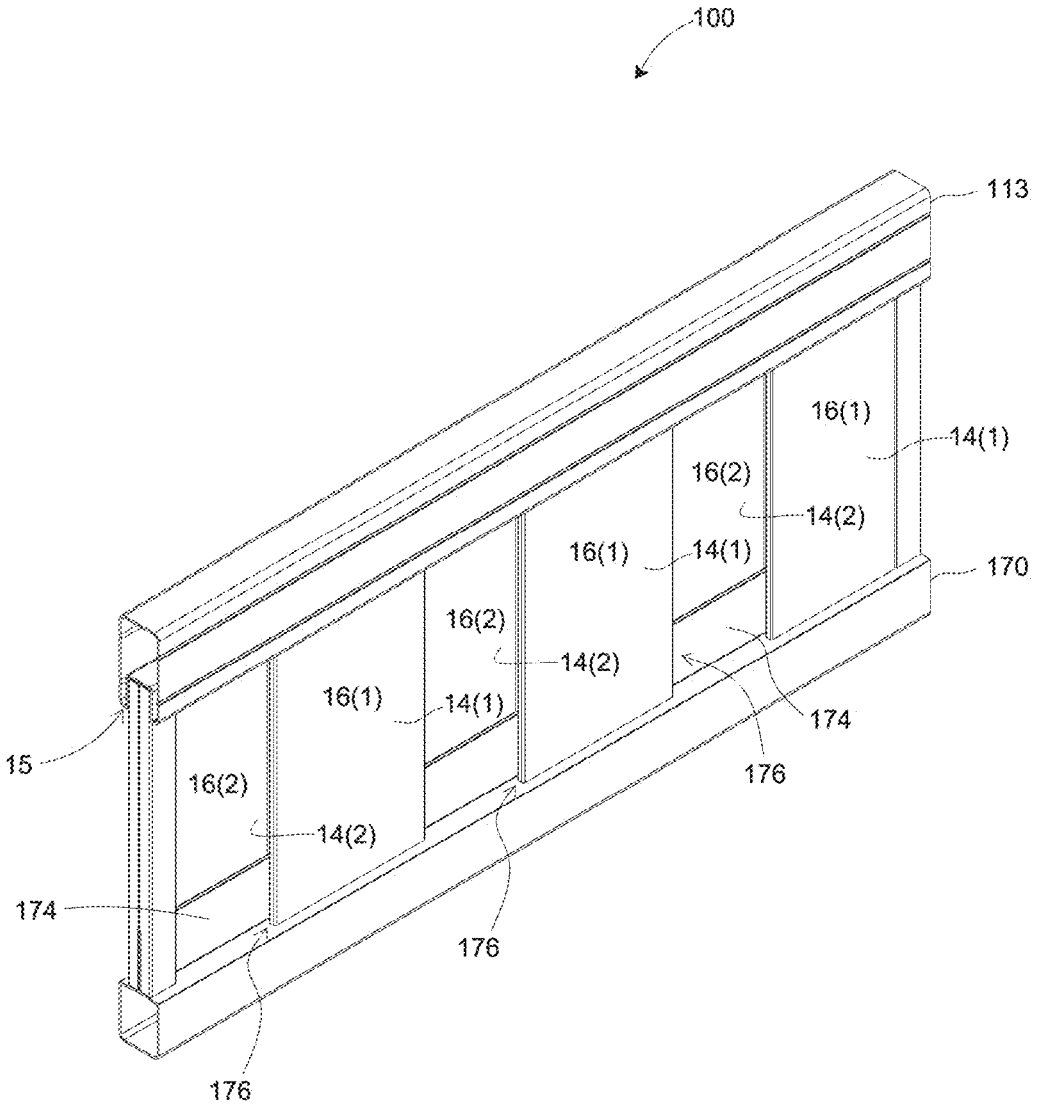
FIG. 17 is a perspective view of a fence system according to another example embodiment of the present disclosure.
Figure 18:
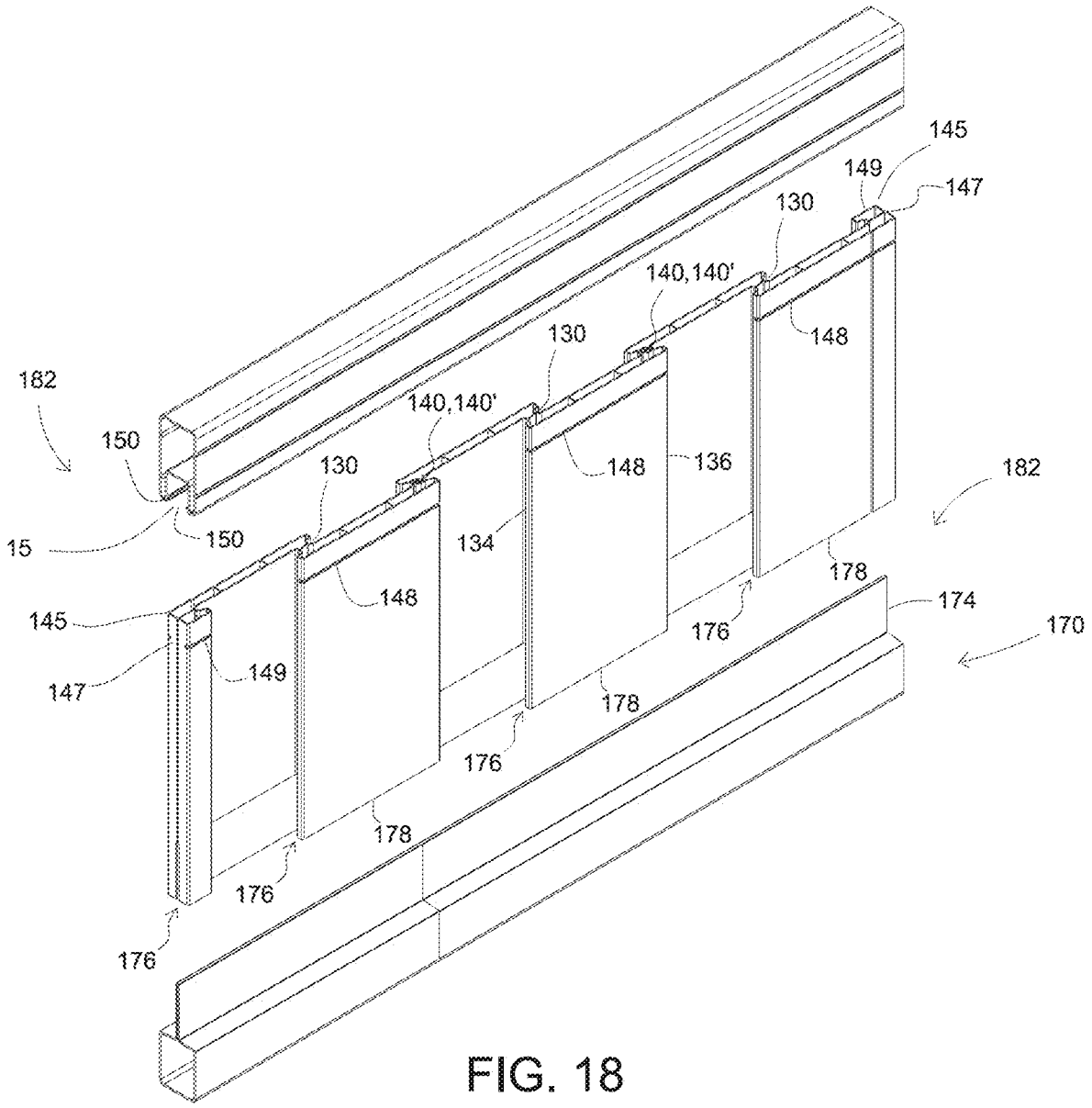
FIG. 18 is an exploded, perspective view of the fence system of FIG. 17.
Figure 19:
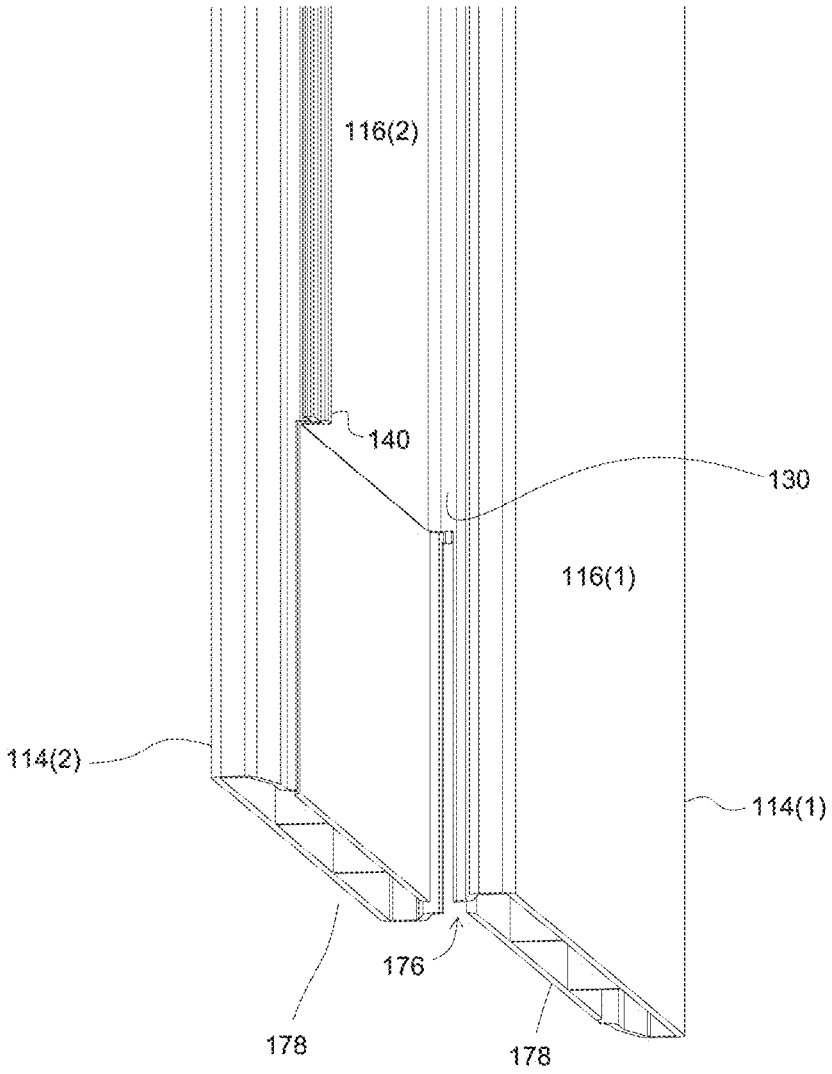
FIG. 19 is a perspective view of an end portion of one of the fence panels of the fence system of FIG. 17.

Referring now to FIGS. 17-19, there is shown another embodiment of the fence system 100 according to an example embodiment of the present disclosure.

In the subject example embodiment, the one or more fence panels 112 are similarly structured to the fence panels 12 described above in connection with the previously described example embodiments wherein like features have been identified with similar reference numerals increased by a factor of 100.

In the subject example embodiment, rather than having upper and lower rails 13 with identical, or substantially identical, upper and lower connection systems 80, 82 as described above in connection with the previously described example embodiments, the fence system 100 includes a lower rail 170 having a lower connection system 182 that includes an interference member 174 extending from the lower rail 170.

The fence panels 112 include an interference member-receiving slot 176 extending through a bottom surface 178 of the fence panel 112 and disposed between respective fence panel portions 114(1), 114(2) of at least a one of the at least one pair of offset adjacent fence panel portions 114(1), 114(2).

In some embodiments, for example, the interference member-receiving slot 176 extends through the web portion 130 the extends between the first fence panel portion 114(1) and the second fence panel portion 114(2) of the pair of offset adjacent fence panel portions 114(1), 114(2).

While the one or more fence panels 112 are disposed on the lower rail 170 so as to effect the connection between the one or more fence panels 112 and the lower rail 170, the interference member 174 extends through the interference member-receiving slot 176 such that lateral movement of the fence panel 112, relative to the lower rail 170, is prevented or substantially prevented.

In some embodiments, for example, the height of the interference member 174 is at least at least about 1/16 of an inch.

In some embodiments, for example, the height of the interference member 174 is at least at least about one (1) inch.

In some embodiments, for example, the height of the interference member 174 is between about 1/16 of an inch and about three (3) inches.

In some embodiments, for example, the height of the interference member 174 is between about is between about one (1) inch and about 1½ inches.

In some embodiments, for example, the length of the interference member 174 is at least at least about 24 inches.

In some embodiments, for example, the length of the interference member 174 is between about 24 inches and about 96 inches.

In some embodiments, for example, while the one or more fence panels 112 are disposed on the lower rail 170 so as to effect the connection between the fence panels 112 and the lower connection system 182, the one or more fence panels 112 are slidable relative to the lower rail 170 in a direction parallel, or substantially parallel, to the longitudinal axis of the lower rail 170.

In some embodiments, for example, while the one or more fence panels 112 are disposed on the lower rail 170 so as to effect the connection between the fence panels 112 and the lower connection system 182, removal of the one or more fence panels 112 from the lower rail 170 in a direction orthogonal, or substantially orthogonal, relative to the longitudinal axis of the lower rail 170 is permitted.

In some embodiments, for example, the upper connection system 180 of the fence system 100 is similar in structure to the upper connection system 80 described above in connection with the previously described fence system 10. Accordingly, the upper connection system 180 includes a first side connection system 181 and a second side connection system 183 wherein the first side connection system 181 includes a first upper connecting projection 150 extending from the upper rail 113, and a first side slot 148 defined within a first side 118 of the fence panel 112, wherein the first upper connecting projection 150 extends into the first side slot 148. In some embodiments, for example, the first upper connecting projection 150 extends into the first side slot 148 for preventing, or substantially preventing, vertical movement of the fence panel 112 relative to the upper rail 113.

The second side connection system 182 includes a second upper connecting projection 150 extending from the upper rail 113, and a second side slot 148 defined within a second side 122 of the fence panel 112, wherein the second upper connecting projection 150 extends into the second side slot 148. In some embodiments, for example, the second upper connecting projection 150 extends into the second side slot 148 for preventing, or substantially preventing, vertical movement of the fence panel 112 relative to the upper rail 113.

In accordance with some example embodiments, the fence system 10, 100 is provided in the form of a kit for assembly of a fence. In some embodiments, for example, the kit includes any one of the example embodiments of the fence panels 12, 112, upper and lower rails 13, 113, 170 and fence posts 60 for assembly a fence.

While various example embodiments have been described, it will be understood that certain adaptations and modifications of the described embodiments can be made. Therefore, the above discussed embodiments are considered to be illustrative and not restrictive.

What is claimed is:

1. A kit for assembling a fence system, comprising:

a plurality of plastic fence panels, wherein each one of the one or more fence panels, independently, includes at least two fence panel portions; and spaced-apart upper and lower longitudinally-extending rails, wherein each one of the fence panels, independently, is connectable to both of the upper and lower longitudinally-extending rails so that the fence panels extend between the upper and lower longitudinally-extending rails;

wherein:

the at least two fence panel portions define at least one pair of offset adjacent fence panel portions; and for each one of the at least one pair of offset adjacent fence panel portions, independently, a first one of the pair of offset adjacent fence panel portions is offset relative to the second one of the pair of offset adjacent fence panel portions; and each one of the fence panels, independently, is formed within a unitary, one-piece construction;

for each one of the fence panels, independently, the connection of the fence panel to the lower rail is via a lower connection system, wherein the lower connection system includes:

an interference member extending from the lower rail;

an interference member-receiving slot extending through a bottom surface of the fence panel and disposed between respective fence panel portions of at least a one of the at least one pair of offset adjacent fence panel portions; and the interference member is configured for extending into the interference member-receiving slot.

2. The kit as claimed in claim 1, wherein the at least two fence panel portions are formed in a unitary, one-piece construction.

3. The kit as claimed in claim 1, wherein:

each one of the fence panels, independently, includes a first side;

each one of the fence panel portions of the pair of offset adjacent fence panel portions, independently, includes a respective first side surface portion of the first side of the fence panel; and for each one of the at least one pair of offset adjacent fence panel portions, independently, the first side surface portion of a first one of the pair of offset adjacent fence panel portions is offset relative to the first side surface portion of the second one of the pair of offset adjacent fence panel portions.

4. The kit as claimed in claim 3, wherein the first side surface portion is defined by a first planar surface; and wherein the first planar surface of a first one of the pair of offset adjacent fence panel portions is offset relative to the first planar surface of the second one of the pair of offset adjacent fence panel portions.

5. The kit as claimed in claim 3, wherein the first planar surface, of a first one of the fence panel portions of the pair of the offset adjacent fence panel portions, is parallel, or substantially parallel, to the respective first planar surface of the second one of the fence panel portions in the pair of offset adjacent fence panel portions.

6. The kit as claimed in claim 5, wherein the first planar surface has a surface area of at least about 36 square inches.

7. The kit as claimed in claim 6, wherein the first planar surface, of a first one of the fence panel portions of the pair of offset adjacent fence panel portions, is offset relative to the first planar surface of the second one of the fence panel portions in the pair of offset adjacent fence panel portions by a minimum distance of at least about ⅛ of an inch.

8. The kit as claimed in claim 6, wherein the first side surface portion has a minimum length of at least about three inches.

9. The kit as claimed in claim 6, wherein the first side surface portion has a minimum height of at least about 12 inches.

10. The kit as claimed in claim 6, further comprising a web portion that extends from a first one of the pair of offset adjacent fence panel portions to the second one of the pair of offset adjacent fence panel portions by a minimum distance of at least about ⅛ of an inch, measured along a longitudinal axis of the web portion.

11. The kit as claimed in claim 6, wherein the offset of a first one of the pair of offset adjacent fence panel portions relative to the second one of the pair of offset adjacent fence panel portions is such that the first one of the pair of offset adjacent fence panel portions is recessed relative to the second one of the pair of offset adjacent fence panel portions.

12. The kit as claimed in claim 6, wherein the one or more fence panels are connectible for obtaining at least one pair of connected fence panels, wherein for each pair of connected fence panels, independently, a first one of the connected fence panels includes a connector that is coupled to a counterpart connector of the second one of the connectible fence panels for effecting the connection of the pair of adjacent fence panels, and wherein the connection is with effect that the connected pair of fence panels defines adjacent fence panels.

13. The kit as claimed in claim 12, wherein the coupling of the connector to the counterpart connector is with effect that disconnection of the connected pair of adjacent fence panels, in response to the combination of:

(i) a first tensile force applied to a first one of the connected fence panels, in a direction parallel to, or substantially parallel to, the respective longitudinal axis of the first one of the connected fence panels, and (ii) a second tensile force applied to the second one of the connected fence panels, in a direction parallel to, or substantially parallel to, the respective longitudinal axis of the second one of the connected fence panels, and in opposition to the first tensile force, is resisted.

14. The kit as claimed in claim 13, wherein the connector and the counterpart connector are co-operatively configured so that their coupling is with effect that the fence panels of the connected fence panels are slidable relative to each other, in a direction orthogonal, or substantially orthogonal, relative to the respective longitudinal axis of either one of, or both of, the connected fence panels for effecting disconnection of the connected fence panels.

15. The kit as claimed in claim 14, wherein the slidability of the fence panels of the connected fence panels, relative to each other, is in a vertical direction.

16. The kit as claimed in claim 12, wherein coupling of the connector and the counterpart is effected by interlocking of the connector and the counterpart connector.

17. The kit as claimed in claim 6, further comprising:

spaced-apart first and second posts, wherein the plurality of fence panels are configured to be assembled in series between the first and second posts; and wherein the assembled plurality of fence panels includes:

a first end panel disposed adjacent to one of the first and second posts; and a second end panel disposed adjacent to the other one of the first and second posts, wherein one of the first and second end panels is a first side symmetrical appearance-creating end panel, the first side symmetrical appearance-creating end panel includes a first side projection extending laterally outwardly relative to an adjacent recessed first side surface portion disposed between the first side projection and the other one of the first and second end panels, wherein the adjacent disposition of the first symmetrical appearance-creating end panel, relative to the one of the first and second posts, has the effect that the first side projection is disposed adjacent to the one of the first and second posts, wherein the first side projection has an outermost surface that defines a first side projection-defined surface that is aligned, or substantially aligned, with a post-adjacent first side surface portion of the other one of the first and second end panels, and wherein the post-adjacent first side surface portion is disposed adjacent to the other one of the first and second posts.

18. The kit as claimed in claim 17, wherein the alignment, or substantial alignment, of the first side projection-defined surface with a post-adjacent first side surface portion of the other one of the first and second end panels, is along a vertical plane.

19. The kit as claimed in claim 17, wherein the assembled plurality of fence panels defines an opaque, or substantially opaque, surface.

20. The kit as claimed in claim 6, wherein for each one of the fence panels, independently, the connection of the fence panel to the upper rail is via an upper connection system;

wherein the upper connection system includes a first side connection system and a second side connection system;

wherein the first side connection system includes a first upper connecting projection extending from the upper rail, and a first side slot defined within a first side of the fence panel, wherein the first upper connecting projection is configured for extending into the first side slot;

wherein the second side connection system includes a second upper connecting projection extending from the upper rail, and a second side slot defined within a second side of the fence panel, wherein the second upper connecting projection is configured for extending into the second side slot;

wherein the lower connection system further includes a first side connection system and a second side connection system;

wherein the first side connection system includes a first lower connecting projection extending from the lower rail, and a first side slot defined within a first side of the fence panel;

wherein the first lower connecting projection is configured for extending into the first side slot;

wherein the second side connection system includes a second lower connecting projection extending from the lower rail, and a second side slot defined within a second side of the fence panel; and wherein the second lower connecting projection is configured for extending into the second side slot.

21. The kit as claimed in claim 20, wherein each one of the first upper connecting projection, the second upper connecting projection, the first lower connecting projection, and the second lower connecting projection, independently, is biased into extension into the corresponding slot.

22. The kit as claimed in claim 1, wherein the interference member has a height that is at least about 1/16 of an inch.

23. A kit, comprising:

a fence panel including at least two adjacent fence panel portions that are offset relative to one another;

a longitudinally extending rail;

an interference member extending from the rail; and an interference member-receiving slot extending through a bottom surface of the fence panel and disposed between the fence panel portions;

wherein the interference member is configured for extending into the interference member-receiving slot.

24. The kit as claimed in claim 23, wherein the interference member has a height that is at least about one inch.

25. The kit as claimed in claim 23, wherein the interference member has a height that is between about 1/16 of an inch and about three inches.

26. The kit as claimed in claim 23, wherein the interference member has a length that is at least about 12 inches.

27. The kit as claimed in claim 23, wherein the slot and the interference member are co-operatively configured so that the length of the interference member is at least about 35% of the length of the fence panel.

* * * * *